US011530612B2

(12) United States Patent
Moon et al.

(10) Patent No.: US 11,530,612 B2
(45) Date of Patent: Dec. 20, 2022

(54) ROTARY COMPRESSOR

(71) Applicant: LG ELECTRONICS INC., Seoul (KR)

(72) Inventors: Seokhwan Moon, Seoul (KR); Kiyoul Noh, Seoul (KR); Bumdong Sa, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 8 days.

(21) Appl. No.: 17/096,059

(22) Filed: Nov. 12, 2020

(65) Prior Publication Data

US 2021/0301818 A1 Sep. 30, 2021

(30) Foreign Application Priority Data

Mar. 25, 2020 (KR) ..... 10-2020-0036505

(51) Int. Cl.
*F03C 2/00* (2006.01)
*F03C 4/00* (2006.01)
(Continued)

(52) U.S. Cl.
CPC ..... *F01C 21/089* (2013.01); *F01C 21/0836* (2013.01); *F01C 21/106* (2013.01);
(Continued)

(58) Field of Classification Search
CPC .. F01C 21/0836; F01C 21/089; F01C 21/106; F01C 21/108; F01C 1/3441; F04C 9/002;
(Continued)

(56) References Cited

U.S. PATENT DOCUMENTS 1,444,269 A * 2/1923 Piatt ..... F04C 2/352 418/257
1,743,539 A * 1/1930 Gasal ..... F01C 21/0836 418/265
(Continued)

FOREIGN PATENT DOCUMENTS

DE 10 2006 012868 9/2007
DE 10 2008 036327 2/2010
(Continued)

OTHER PUBLICATIONS

Korean Office Action dated Sep. 15, 2021 issued in Application No. 10-2020-0036505.
(Continued)

*Primary Examiner* — Theresa Trieu
(74) *Attorney, Agent, or Firm* — KED & Associates

(57) ABSTRACT

A rotary compressor may include a rotational shaft, a first bearing and a second bearing each supporting the rotational shaft in a radial direction, a cylinder disposed between the first bearing and the second bearing and forming a compression space, a roller disposed in the compression space to form a contact point spaced at a predetermined interval from the cylinder and coupled to the rotational shaft to compress a refrigerant in response to rotation of the roller, and at least one vane slidably inserted into the roller and in contact with an inner circumferential surface of the cylinder and dividing the compression space into a plurality of compression chambers.

2 Claims, 16 Drawing Sheets

(51) Int. Cl.

| | |
|---|---|
| ***F04C 2/00*** | (2006.01) |
| ***F04C 18/00*** | (2006.01) |
| ***F01C 21/08*** | (2006.01) |
| ***F04C 18/344*** | (2006.01) |
| ***F01C 21/10*** | (2006.01) |

(52) U.S. Cl.
CPC ..... *F04C 18/3441* (2013.01); *F04C 2240/50* (2013.01); *F04C 2240/60* (2013.01)

(58) Field of Classification Search
CPC ..... F04C 18/344; F04C 18/3441; F04C 2210/26; F04C 2240/10; F04C 2240/20; F04C 2240/50; F04C 2240/60
See application file for complete search history.

(56) References Cited

U.S. PATENT DOCUMENTS

| | | | | |
|---|---|---|---|---|
| 2,650,754 | A | 9/1953 | Simon | |
| 4,299,097 | A | 11/1981 | Shank et al. | |
| 4,410,305 | A | 10/1983 | Shank et al. | |
| 4,521,167 | A | 6/1985 | Cavalieri et al. | |
| 4,799,867 | A | 1/1989 | Sakamaki et al. | |
| 4,859,163 | A | 8/1989 | Schuller | |
| 4,886,392 | A | 12/1989 | Iio | |
| 4,955,985 | A | 9/1990 | Sakamaki et al. | |
| 5,044,910 | A * | 9/1991 | Sakamaki ..... | F01C 21/0809 418/261 |
| 5,160,252 | A | 11/1992 | Edwards | |
| 5,302,096 | A | 4/1994 | Cavalleri | |
| 9,115,716 | B2 | 8/2015 | Sekiya et al. | |
| 2009/0285709 | A1 | 11/2009 | Mooy et al. | |
| 2012/0009078 | A1 | 1/2012 | Maeyama | |
| 2013/0149178 | A1 | 6/2013 | Sekiya | |
| 2013/0266466 | A1* | 10/2013 | Yang ..... | F01C 21/0836 418/260 |
| 2014/0140866 | A1 | 5/2014 | Pfister et al. | |
| 2021/0301818 | A1 | 9/2021 | Moon | |

FOREIGN PATENT DOCUMENTS

| | | |
|---|---|---|
| DE | 10 2013 223999 | 5/2015 |
| EP | 2 219 917 | 12/2011 |
| JP | S58-8201 | 1/1983 |
| JP | 2002-039084 | 2/2002 |
| JP | 2002-155878 | 5/2002 |
| JP | 2006-152903 | 6/2006 |
| JP | 5445550 | 1/2014 |
| JP | 2015-117608 | 6/2015 |
| JP | 5932608 | 6/2016 |
| KR | 20-1999-0014251 | 4/1999 |
| KR | 10-2011-0106045 | 9/2011 |
| KR | 10-2012-0112790 | 10/2012 |
| KR | 10-2018-0080885 | 7/2018 |
| KR | 10-2018-0094411 | 8/2018 |
| KR | 10-2020-0054026 | 5/2020 |
| WO | WO 94/09260 | 4/1994 |
| WO | WO 95/35431 | 12/1995 |
| WO | WO 2013/105463 | 7/2013 |
| WO | WO 2020/042435 | 3/2020 |

OTHER PUBLICATIONS

Korean Office Action dated Mar. 23, 2021.
European Search Report issued in Application No. 21164461.2 dated Jun. 4, 2021.
Korean Office Action dated Jun. 15, 2021 (61626).
Korean Office Action dated Jun. 15, 2021 (61630).
European Search Report issued in Application No. 21165131.0 dated Aug. 13, 2021.
Korean Office Action dated Aug. 20, 2021 issued in Application No. 10-2020-0082373.
European Search Report dated Oct. 4, 2021 issued in Application No. 21171474.6.
U.S. Office Action dated Apr. 8, 2022 issued in U.S. Appl. No. 17/177,683.
U.S. Office Action dated Aug. 5, 2022 issued in U.S. Appl. No. 17/181,076.
U.S. Appl. No. 17/096,059, filed Nov. 12, 2020.
U.S. Appl. No. 17/181,076, filed Feb. 22, 2021.
U.S. Appl. No. 17/183,505, filed Feb. 24, 2021.
U.S. Appl. No. 17/179,708, filed Feb. 19, 2021.
U.S. Appl. No. 17/177,683, filed Feb. 17, 2021.

* cited by examiner

ROTARY COMPRESSOR

CROSS-REFERENCE TO RELATED APPLICATION(S)

This application claims priority under 35 U.S.C. § 119 to Korean Application No. 10-2020-0036505 filed in Korea on Mar. 25, 2020, whose entire disclosure is hereby incorporated by reference.

BACKGROUND

1. Field

A rotary compressor is disclosed herein.

2. Background

Generally, a compressor is an apparatus that receives power from a power generating apparatus, such as a motor or a turbine, and compresses a working fluid, such as air or refrigerant. Compressors are widely applied to industrial and household appliances, such as for a steam compression chamber refrigeration cycle (hereinafter referred to as a "refrigeration cycle").

The compressors may be classified into a reciprocating compressor, a rotary compressor, and a scroll compressor according to a method of compressing a refrigerant. The rotary compressor may be divided into a method in which a vane is slidably inserted into a cylinder to contact a roller, and a method in which a vane slips into a roller to contact a cylinder. Generally, the former is referred to as a "rotary compressor", and the latter is referred to as a "vane rotary compressor".

In the rotary compressor, the vane inserted into the cylinder is drawn out toward the roller by an elastic force or back pressure, and thereby is brought into contact with an outer circumferential surface of the roller. On the other hand, in the vane rotary compressor, the vane inserted in the roller rotates with the roller and is drawn by a centrifugal force and back pressure to contact the inner circumferential surface of the cylinder.

The rotary compressor independently forms compression chambers as many as a number of vanes per rotation of the rollers, so that each compression chamber simultaneously performs suction, compression, and discharge strokes. On the other hand, the vane rotary compressor continuously forms as many compression chambers as a number of vanes per rotation of the roller, and the respective compression chambers sequentially perform suction, compression, and discharge strokes.

In the vane rotary compressor, friction loss is increased compared to a general rotary compressor as a plurality of vanes is usually rotated with a roller and a front end surface of each of the vanes slides in contact with the inner circumferential surface of the cylinder. In addition, the vane rotary compressor may have an inner circumferential surface of the cylinder in a circular shape, but recently there has been introduced a vane rotary compressor (hereinafter, referred to as a "hybrid rotary compressor") having a so-called hybrid cylinder, an inner circumferential surface of which is formed in an elliptical shape or in a shape of a combination of an ellipse and a circle to reduce frictional losses and improve compression efficiency.

In such a hybrid rotary compressor, due to a characteristic that the inner circumferential surface of the cylinder is formed in an asymmetrical shape, efficiency of the compressor is greatly affected by a position at which a contact point is formed to distinguish a region where refrigerant is introduced and a compression stroke starts and a region in which a discharge stroke of the compressed refrigerant is performed.

In particular, in a structure in which a suction port and a discharge port are sequentially adjacent in a direction opposite to a rotational direction of the roller in order to increase a compression path as much as possible to achieve a high compression ratio, the position of the contact point greatly affects the efficiency of the compressor. However, the compression efficiency decreases due to the contact between the vane and the cylinder, and a reliability problem occurs due to wear.

BRIEF DESCRIPTION OF THE DRAWINGS

Embodiments will be described in detail with reference to the following drawings in which like reference numerals refer to like elements, and wherein.

DETAILED DESCRIPTION

Figure 1:
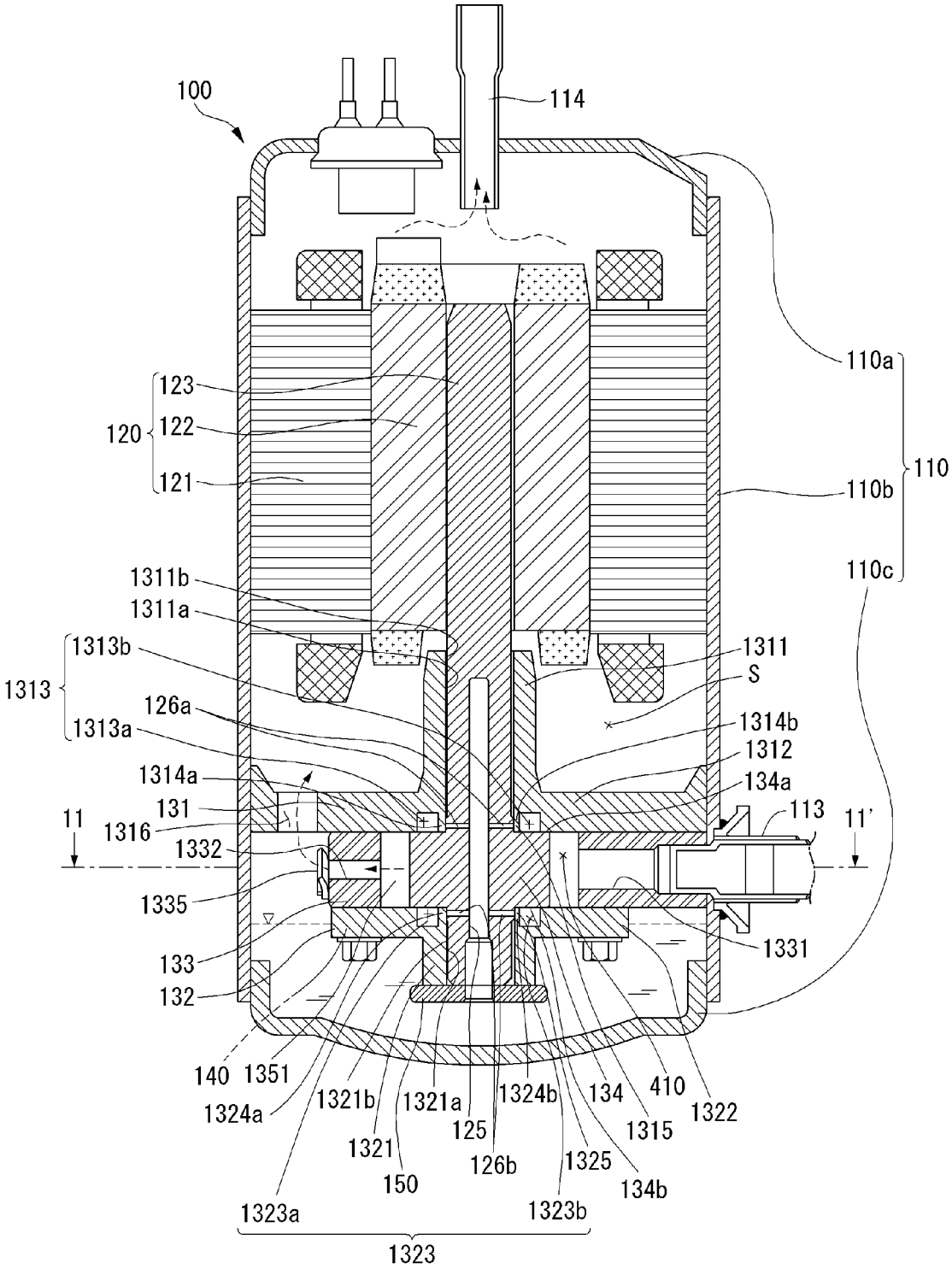
FIG. 1 is a longitudinal cross-sectional view of a rotary compressor according to an embodiment.

Hereinafter, embodiments will be described with reference to the accompanying drawings. The same or similar elements have been given the same or similar reference numerals, and repetitive description has been omitted.

It will be understood that when a component is referred to as being "connected to" or "coupled to" another component, it may be directly connected to or coupled to another component or intervening components may be present.

In addition, in the following description of the embodiments a detailed description of known functions and configurations incorporated herein will be omitted when it may make the subject matter of embodiments unclear. In addition, the accompanying drawings are provided only for a better understanding of the embodiments and are not intended to limit the technical ideas. Therefore, it should be understood that the accompanying drawings include all modifications, equivalents and substitutions included in the scope and sprit.

Figure 2:
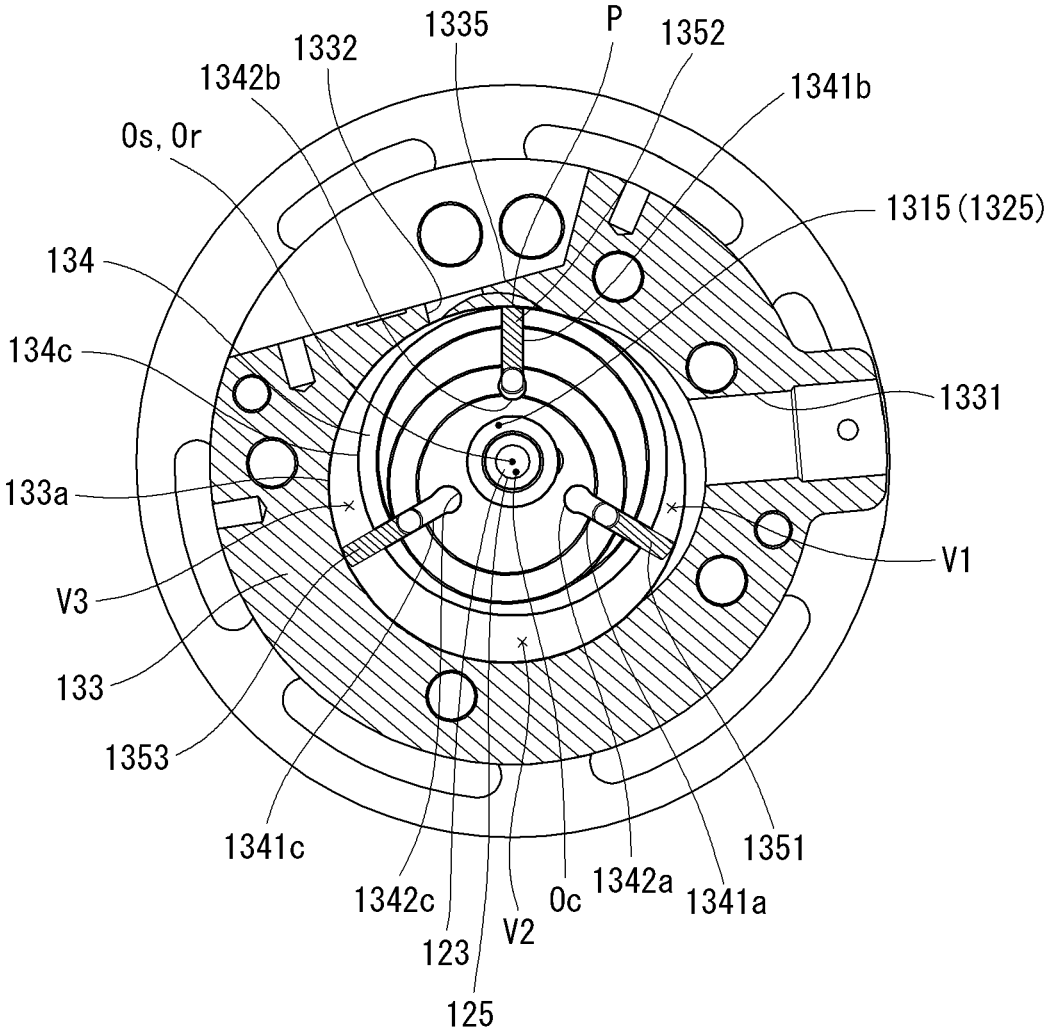
FIG. 2 is a cross-sectional view taken along line II-II' in FIG. 1.
Figure 3:
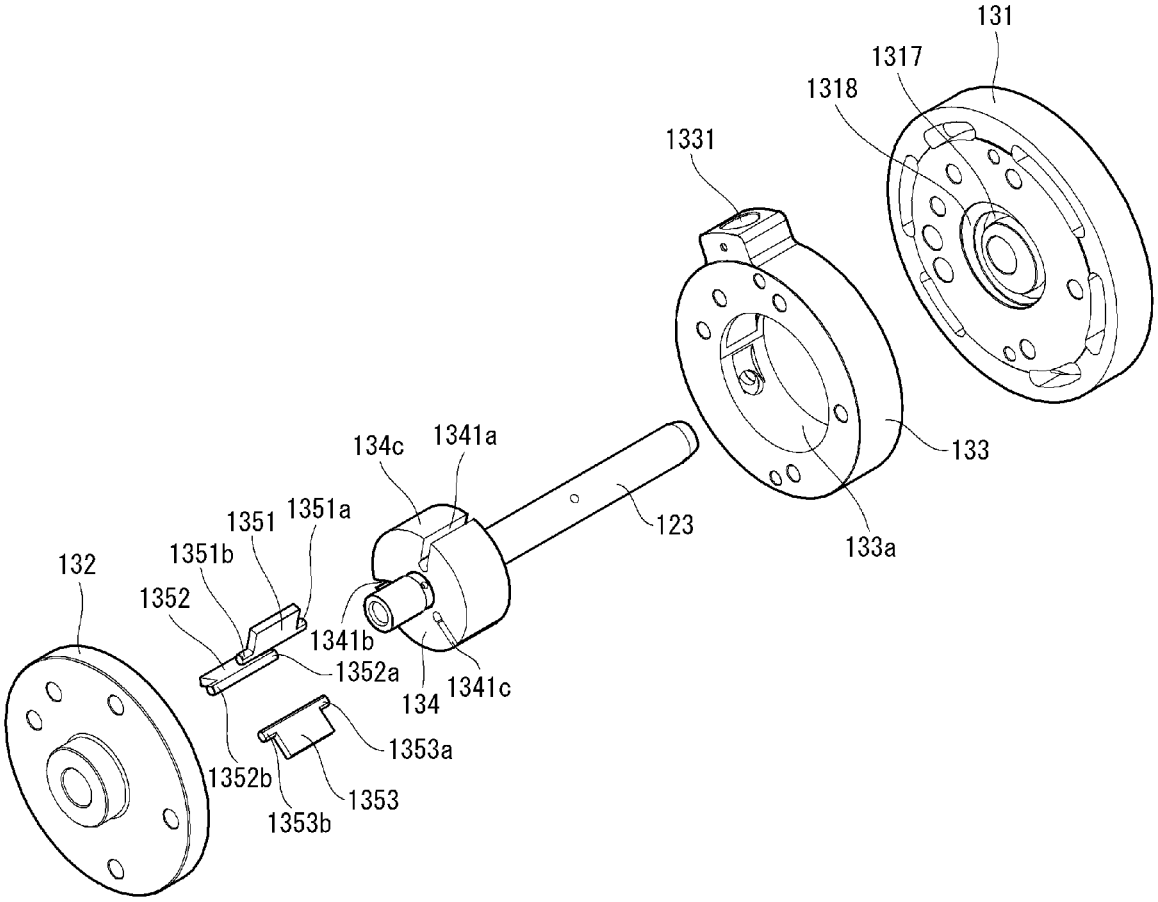
FIGS. 3 and 4 are exploded perspective views of a rotary compressor according to an embodiment.
Figure 4:
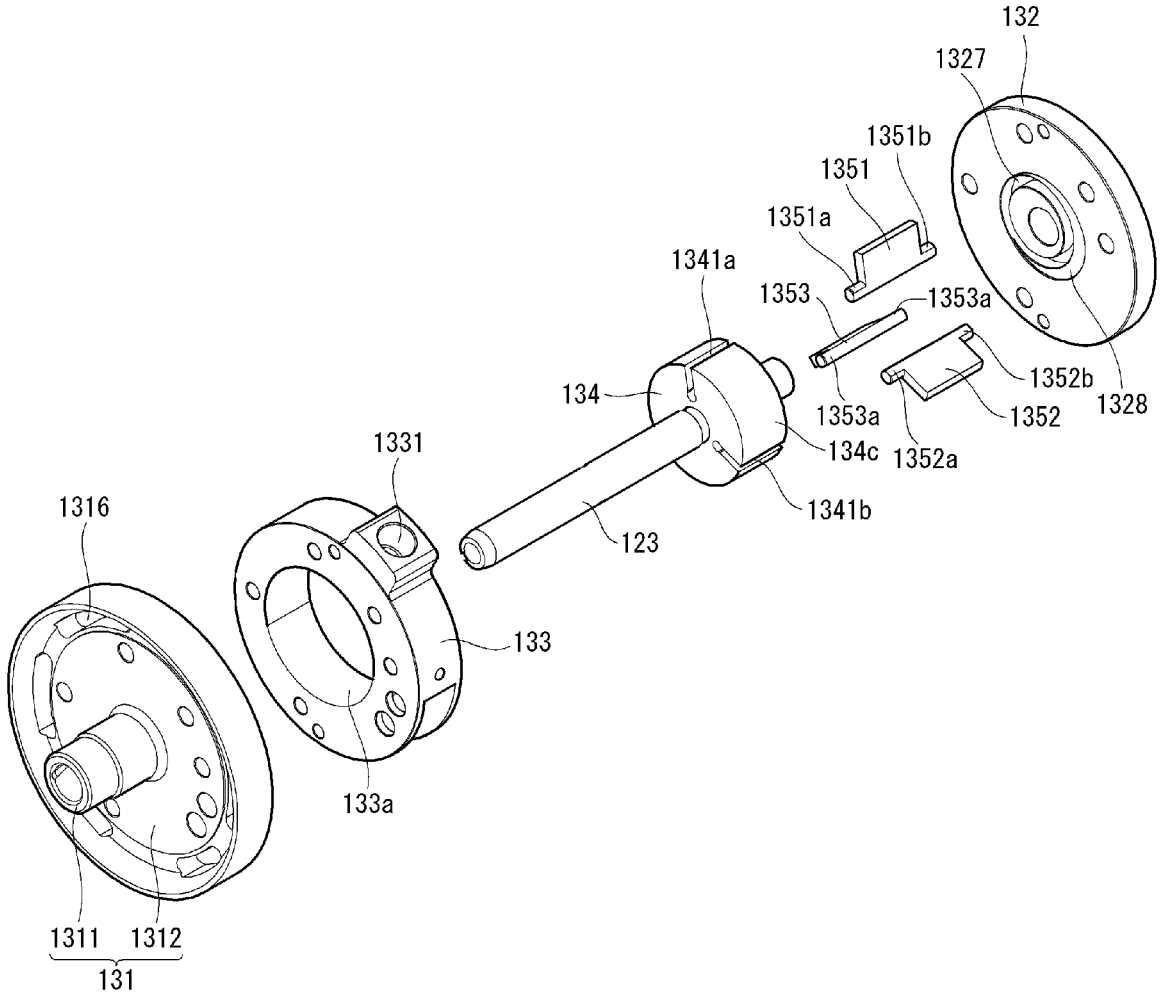
Figure 5:
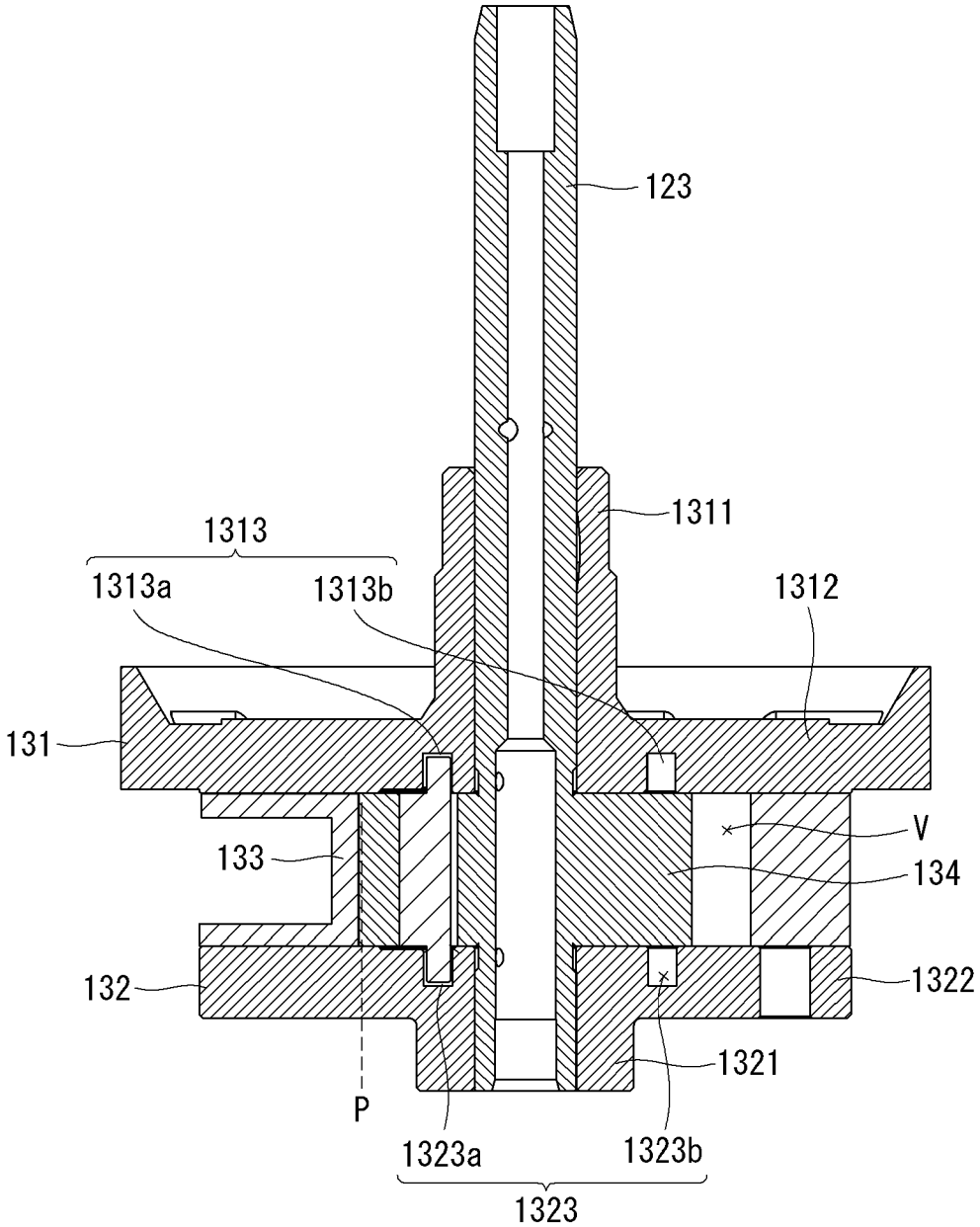
FIG. 5 is a longitudinal cross-sectional view of components of a rotary compressor according to an embodiment.
Figure 6:
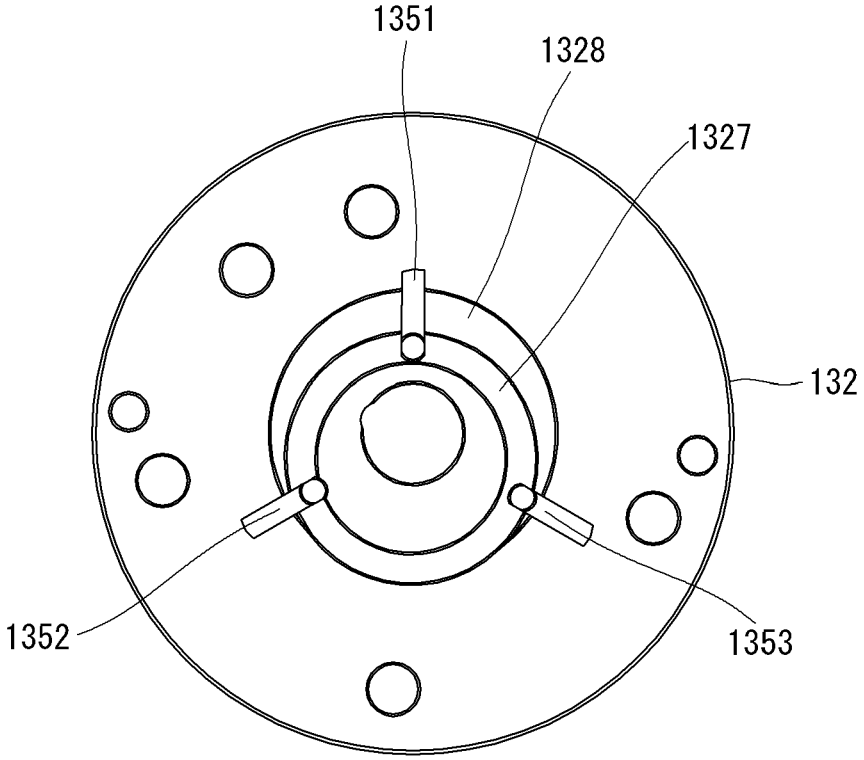
FIG. 6 is a plan view of components of a rotary compressor according to an embodiment.
Figure 7:
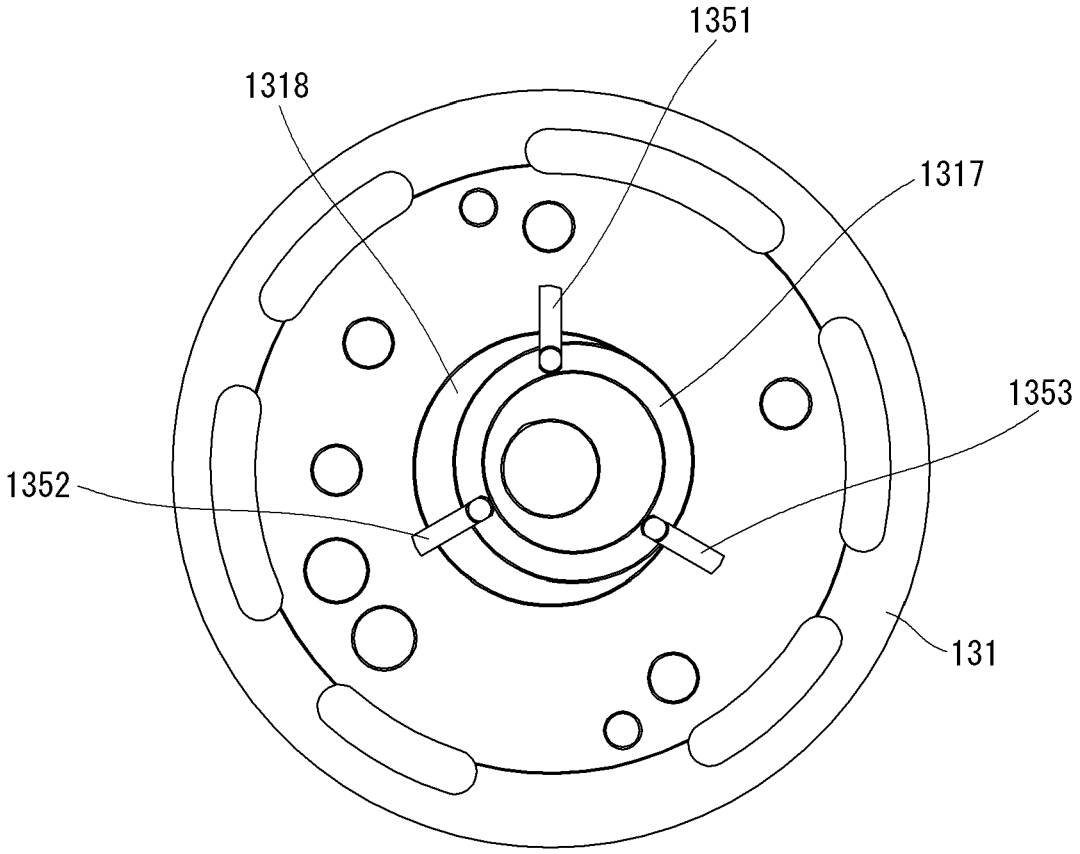
FIG. 7 is a bottom view of components of a rotary compressor according to an embodiment.
Figure 8:
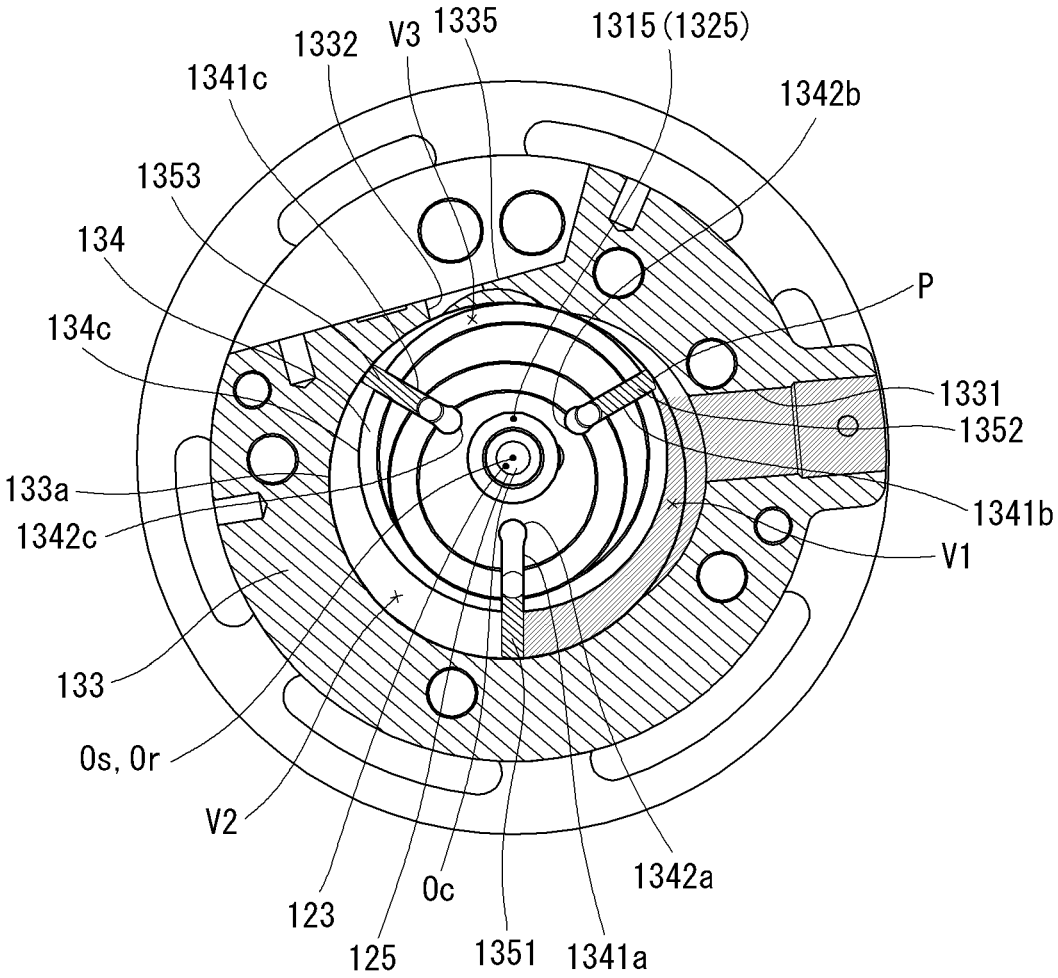
FIGS. 8 to 10 are operational diagrams of a rotary compressor according to an embodiment.
Figure 9:
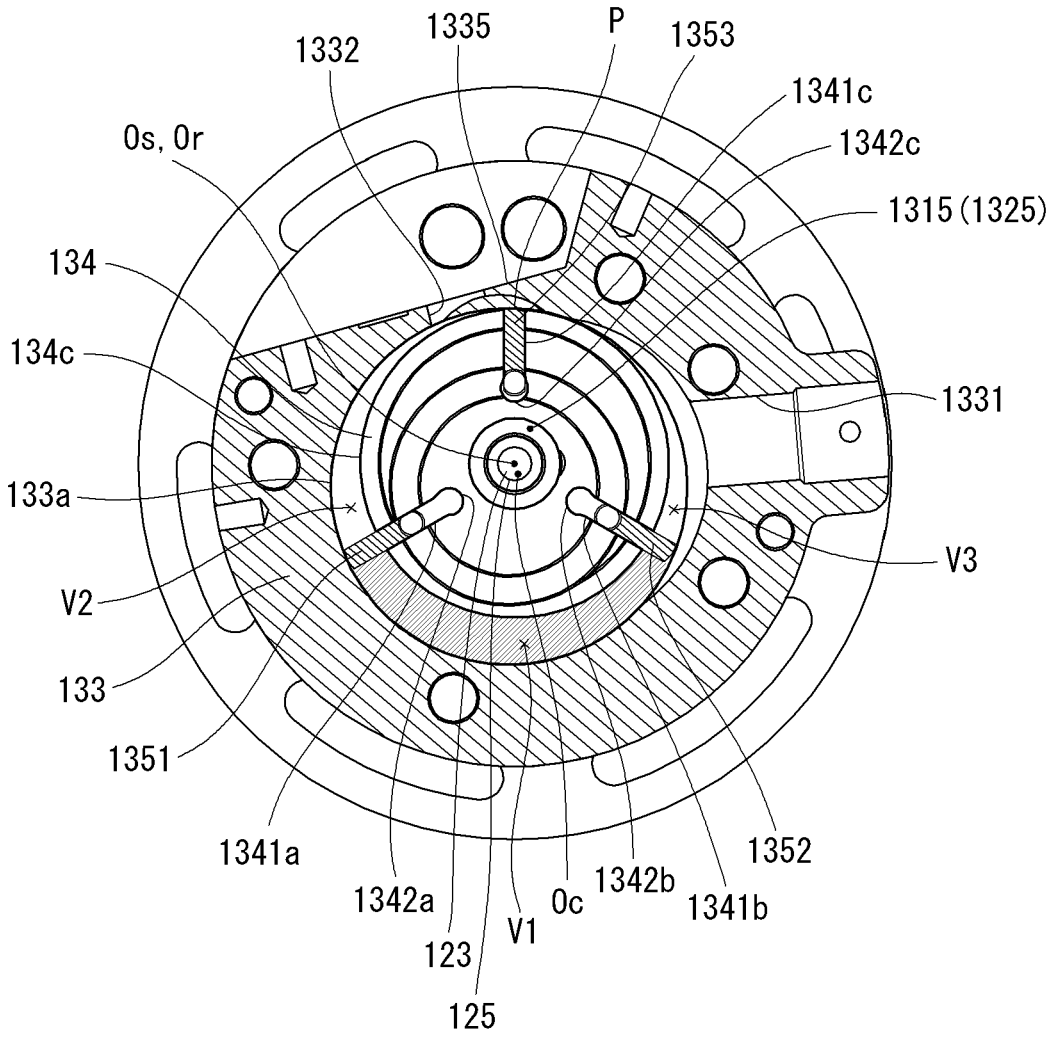
Figure 10:
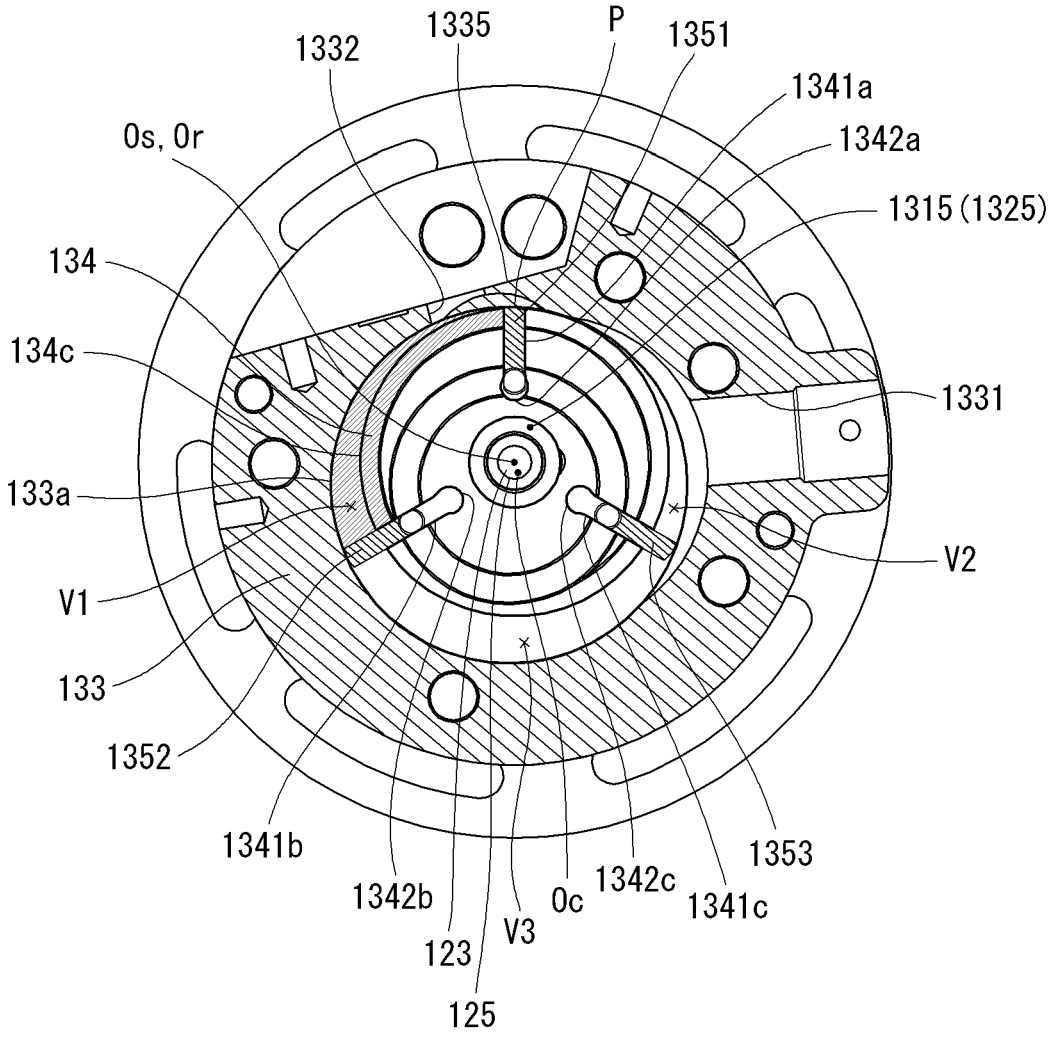
Figure 11:
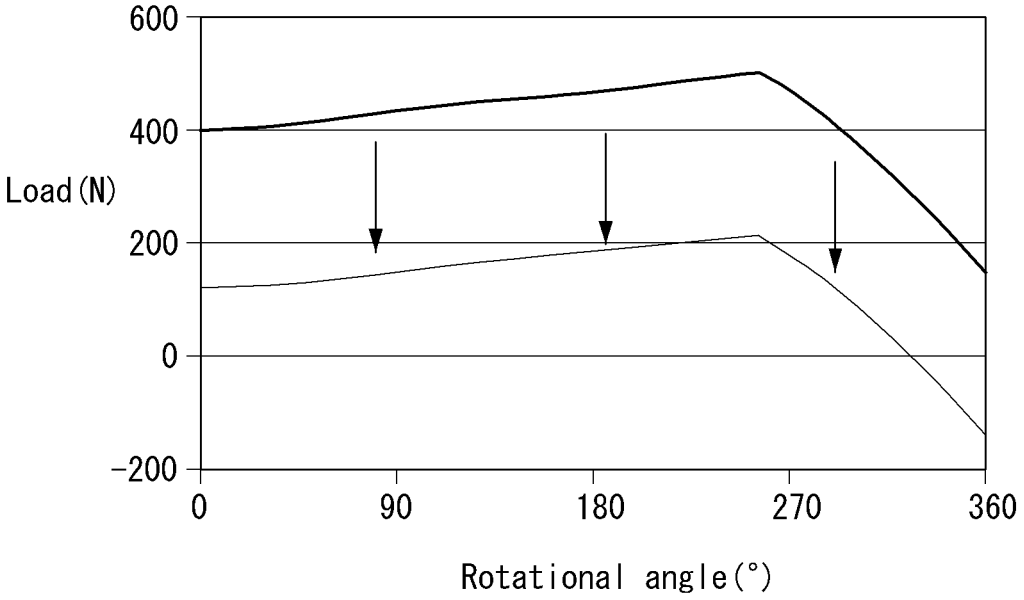
FIG. 11 is a graph showing a load applied to a pin in response to rotation of the rotary compressor according to an embodiment.

FIG. 1 is a longitudinal cross-sectional view of a rotary compressor according to an embodiment. FIG. 2 is a cross-sectional view taken along line II-II' in FIG. 1. FIGS. 3 and 4 are exploded perspective views of a rotary compressor according to an embodiment. FIG. 5 is a longitudinal cross-sectional view of components of a rotary compressor according to an embodiment. FIG. 6 is a plan view of components of a rotary compressor according to an embodiment. FIG. 7 is a bottom view of components of a rotary compressor according to an embodiment. FIGS. 8 to 10 are operational diagrams of a rotary compressor according to an embodiment. FIG. 11 is a graph showing a load applied to a pin in response to rotation of the rotary compressor according to an embodiment.

Referring to FIGS. 1 to 11, a rotary compressor 100 according to an embodiment may include a casing 110, a drive motor 120, and a compression unit 131, 132, 133, and 134. However, any embodiments are not limited to this configuration.

The casing 110 may form an external appearance of the rotary compressor 100. The casing 110 may be formed in a cylindrical shape. The casing 110 may be divided into a vertical type or a horizontal type according to an installed embodiment of the rotary compressor 100. The vertical type may be a structure in which the drive motor 120 and the compression unit 131, 132, 133, and 134 are disposed on both an upper side and a lower side along an axial direction, and the horizontal type may be a structure in which the drive motor 120 and the compression unit 131, 132, 133, and 134 are disposed on both a left or first side and a right or second side. A drive motor 120, a rotational shaft 123, and compression unit 131, 132, 133, and 134 may be disposed inside of the casing 110. The casing 110 may include an upper shell 110*a*, an intermediate shell 110*b*, and a lower shell 110*c*. The upper shell 110*a*, the intermediate shell 110*b*, and the lower shell 110*c* may seal an internal space S.

The drive motor 120 may be disposed in the casing 110. The drive motor 120 may be disposed inside of the casing 110. The compression unit 131, 132, 133, and 134 mechanically connected by the rotational shaft 123 may be installed on one side of the drive motor 120.

The drive motor 120 may provide power to compress a refrigerant. The drive motor 120 may include a stator 121, a rotor 122, and the rotational shaft 123. The stator 121 may be disposed in the casing 110. The stator 121 may be disposed inside the casing 110. The stator 121 may be fixed to an inside of the casing 110. The stator 121 may be mounted on an inner circumferential surface of the cylindrical casing 110 by shrink fitting, for example. For example, the stator 121 may be fixed to and installed on an inner circumferential surface of the intermediate shell 110*b*.

The rotor 122 may be spaced apart from the stator 121. The rotor 122 may be disposed radially inward compared to the stator 121. The rotational shaft 123 may be disposed at a center of the rotor 122. The rotational shaft 123 may be, for example, press-fitted to the center of the rotor 122.

The rotational shaft 123 may be disposed in the rotor 122. The rotational shaft 123 may be disposed at the center of the rotor 122. The rotational shaft 123 may be, for example, press-fitted to the center of the rotor 122.

When power is applied to the stator 121, the rotor 122 may be rotated by electromagnetic interaction between the stator 121 and the rotor 122. Accordingly, the rotational shaft 123 coupled to the rotor 122 may rotate concentrically with the rotor 122.

An oil flow path 125 may be formed at a center of the rotational shaft 123. The oil flow path 125 may extend in the axial direction. Oil passage holes 126*a* and 126*b* may be formed at a middle of the oil flow path 125 toward an outer circumferential surface of the rotational shaft 123.

The oil passing holes 126*a* and 126*b* may include a first oil passing hole 126*a* belonging to a range of a first shaft accommodating portion 1311 and a second oil passing hole 126*b* belonging to a range of a second shaft accommodating portion 1321. Each of the first oil passing hole 126*a* and the second oil passing hole 126*b* may be formed as a single hole or a plurality of holes.

An oil feeder 150 may be disposed in the middle of or below the oil flow path 125. When the rotational shaft 123 is rotated, oil filled in a lower portion of the casing 110 may be pumped by the oil feeder 150. Accordingly, the oil may rise along the oil flow path 125 and be then supplied to a sub bearing surface 1321*a* through the second oil passage hole 126*b* and to a main bearing surface 1311*a* through the first oil passage hole 126*a*.

The first oil passage hole 126*a* may overlap a first oil groove 1311*b*. The second oil passage hole 126*b* may overlap a second oil groove 1321*b*. That is, the oil supplied to the main bearing surface 1311*a* of a main bearing 131 and the sub bearing surface 1321*a* of a sub bearing 132 through the first oil passage hole 126*a* and the second oil passage hole 126*b* may be quickly introduced to a second main-side pocket 1313*b* and a second sub-side pocket 1323*b*.

The compression unit 131, 132, 133, and 134 may include the main bearing 131 installed on both sides in the axial direction, a cylinder 133 in which a compression space 410 is formed by the sub bearings 132, and a roller 134 rotatably disposed inside of the cylinder 133. Referring to FIGS. 1 and 2, the main bearing 131 and the sub bearing 132 may be disposed in the casing 110. The main bearing 131 and the sub bearing 132 may be fixed to the casing 110. The main bearing 131 and the sub bearing 132 may be spaced apart from each other along the rotational shaft 123. The main bearing 131 and the sub bearing 132 may be spaced apart from each other in the axial direction. In one embodiment, the axial direction may refer to a vertical direction in FIG. 1.

The main bearing 131 and the sub bearing 132 may support the rotational shaft 123 in a radial direction. The main bearing 131 and the sub bearing 132 may support the cylinder 133 and the roller 134 in the axial direction. The main bearings 131 and the sub bearings 132 have a shaft accommodating portion 1311 and 1321 that radially supports the rotational shaft 123, and a flange 1312 and 1322 that extends in the radial direction. More specifically, the main bearing 131 may include first shaft accommodating portion 1311 that radially supports the rotational shaft 123 and first flange portion 1312 that extends radially from the first shaft accommodating portion 1311. In addition, the sub bearing 132 may include the second shaft accommodating portion 1321 that radially supports the rotational shaft 123, and second flange 1322 that extends radially from the second shaft accommodating portion 1321.

The first shaft accommodating portion 1311 and the second shaft accommodating portion 1321 may each be formed in a bush shape. The first flange portion 1312 and the second flange portion 1322 may be formed in a disc shape. First oil groove 1311*b* may be formed in the main bearing surface 1311*a* which is a radial inner circumferential surface of the first shaft accommodating portion 1311. Second oil groove 1321*b* may be formed in the sub bearing surface 1321*a* which is a radial inner circumferential surface of the second shaft accommodating portion 1321. The first oil groove 1311*b* may be formed in a shape of a straight line or a diagonal line between upper and lower ends of the first shaft accommodating portion 1311. The second oil groove 1321*b* may be formed in a shape of a straight line or a diagonal line between both ends of the second shaft accommodating portion 1321.

A first communication flow path 1315 may be formed in the first oil groove 1311*b*. A second communication flow path 1325 may be formed in the second oil groove 1321*b*. The first communication flow path 1315 and the second communication flow path 1325 may guide oil introduced into the main bearing surface 1311*a* and the sub bearing surface 1321*a* to a main-side back pressure pocket 1313 and a sub-side back pressure pocket 1323.

The main-side back pressure pocket 1313 may be formed in the first flange 1312. The sub-side back pressure pocket 1323 may be formed in the second flange 1322. The main-side back pressure pocket 1313 may include first main-side pocket 1313*a* and second main-side pocket 1313*b*. The sub-side back pressure pocket 1323 may include first sub-side pocket 1323*a* and second sub-side pocket 1323*b*.

The first main-side pocket 1313*a* and the second main-side pocket 1313*b* may be formed at a predetermined interval along a circumferential direction. The first sub-side pocket 1323*a* and the second sub-side pocket 1323*b* may be formed at a predetermined interval along the circumferential direction.

The first main-side pocket 1313*a* may form a lower pressure than the second main-side pocket 1313*b*, for example, an intermediate pressure between a suction pressure and a discharge pressure. The first sub-side pocket 1323*a* may form a lower pressure than the second sub-side pocket 1323*b*, for example, an intermediate pressure between a suction pressure and a discharge pressure. The pressure of the first main-side pocket 1313*a* and the pressure of the first sub-side pocket 1323*a* may correspond to each other.

As the oil passes through a micro flow path between a first main-side bearing protrusion 1314*a* and an upper surface 134*a* of the roller 134 and then flows into the first main-side pocket 1313*a*, the first main-side pocket 1313*a* may be depressurized, thereby forming an intermediate pressure. As the oil passes through a micro flow path between a first sub-side bearing protrusion 1324*a* and a lower surface 134*b* of the roller 134 and then flows into the first sub-side pocket 1323*a*, the first sub-side pocket 1323*a* may be depressurized, thereby forming an intermediate pressure.

As the oil flowing into the main bearing surface 1311*a* through the first oil passing hole 126*a* flows into the second main-side pocket 1313*b* through the first communication flow path 1315, the second main-side pocket 1313*b* may be maintained at the discharge pressure or may be maintained at a pressure similar to the discharge pressure. As the oil flowing into the sub bearing surface 1321*a* through the second oil passing hole 126*b* flows into the second side pocket 1323*b* through the second communication flow path 1325, the second side pocket 1323*b* may be maintained at the discharge pressure or may be maintained at a pressure similar to the discharge pressure.

The inner circumferential surface of the cylinder 133, which forms the compression space 410, may be formed in a circular shape. Alternatively, the inner circumferential surface of the cylinder 133 may be formed in a symmetrical elliptical shape having a pair of long axes and short axes, or an asymmetrical elliptical shape having several pairs of major axes and minor axes. The outer circumferential surface of the cylinder 133 may be formed in a circular shape. However, the shape of the outer circumferential surface of the cylinder 133 may be modified into any of various shapes as long as the outer circumferential surface of the cylinder 133 may be fixed to the inner circumferential surface of the casing 110. The cylinder 133 may be fastened with a bolt to the main bearing 131 or the sub bearing 132 which is fixed to the casing 110.

An empty space may be formed at a central portion of the cylinder 133 to form the compression space 410 with the inner circumferential surface of the cylinder 133. The empty space may be sealed by the main bearing 131 and the sub bearing 132 to form the compressed space 410. In the compression space 410, the roller 134 having a circular outer circumferential surface may be rotatably disposed.

In the inner circumferential surface 133*a* of the cylinder 133, a suction port 1331 and a discharge port 1332 may be respectively formed on both sides in the circumferential direction around a contact point P where the inner circumferential surface 133*a* of the cylinder 133 and the outer circumferential surface 134*c* of the roller 134 are nearly in contact. The suction port 1331 and the discharge port 1332 may be spaced apart from each other. That is, the suction port 1331 may be formed at a downstream side of a compression flow path (in a rotational direction), and the discharge port 1332 may be formed at an upstream side in a direction in which the refrigerant is compressed.

The suction port 1331 may be directly connected to a suction pipe 113 passing through the casing 110. The discharge port 1332 may be indirectly connected to a discharge pipe 114, which communicates with internal space S of the casing 110 to be thereby coupled to the casing 110. Accordingly, a refrigerant may be suctioned directly into the compression space 410 through the suction port 1331, and the compressed refrigerant may be discharged into the internal space S of the casing 110 through the discharge port 1332 and then discharged through the discharge pipe 114. Therefore, the internal space S of the casing 110 may be maintained in a high-pressure state which is a discharge pressure.

More specifically, high-pressure refrigerant discharged from the discharge port 1332 may stay in the internal space S adjacent to the compression unit 131, 132, 133, and 134. As the main bearing 131 is fixed to the inner circumferential surface of the casing 110, upper and lower sides of the internal space S of the casing 110 may be bounded. In this case, the high-pressure refrigerant remaining in the internal space S may rise along discharge flow path 1316 and be discharged to the outside through the discharge pipe 114 provided in the upper side of the casing 110.

Discharge flow path 1316 may penetrate the first flange 1312 of the main bearing 131 in the axial direction. The discharge flow path 1316 may secure a sufficient flow path area so that flow path resistance does not occur. More specifically, the discharge flow path 1316 may extend along the circumferential direction in a region that does not overlap the cylinder 133 in the axial direction. That is, the discharge flow path 1316 may form an arc shape.

The discharge flow path 1316 may be formed of a plurality of holes spaced apart in the circumferential direction. As described above, as a maximum flow path area is secured, flow path resistance may be reduced when the high-pressure refrigerant moves to the discharge pipe 114 provided on the upper side of the casing 110.

A separate suction valve may not be installed at the suction port 1331, whereas a discharge valve 1335 that opens and closes the discharge port 1332 may be disposed at the discharge port 1332. The discharge valve 1335 may include a lead-type valve having one or a first end fixed and the other or a second end formed as a free end. Alternatively, the discharge valve 1335 may be variously changed as necessary. For example, the discharge valve 1335 may be a piston valve.

When the discharge valve 1335 is implemented as a lead-type valve, a discharge groove (not shown) may be formed in the outer circumferential surface of the cylinder 133 so that the discharge valve 1335 may be mounted. Accordingly, a length of the discharge port 1332 may be reduced to a minimum, thereby reducing the dead volume. At least a portion of the valve groove may be formed in a triangular shape so as to secure a flat valve seat surface as shown in FIG. 2.

According to one embodiment, the discharge port 1332 provided as a single port is described as an example; however, embodiments are not limited thereto. The discharge port 1332 may be provided as plurality of ports along a compression path (compression direction).

The roller 134 may be disposed in the cylinder 133. The roller 134 may be disposed inside of the cylinder 133. The roller 134 may be disposed in the compression space 410 of the cylinder 133. An outer circumferential surface 134*c* of the roller 134 may be formed in a circular shape. The rotational shaft 123 may be disposed at the center of the roller 134. The rotational shaft 123 may be integrally coupled to the center of the roller 134. The roller 134 may have a center Or coinciding with a center Os of axis of the rotational shaft 123 and may be concentrically rotated with the rotational shaft 123 around the center Or of the roller 134.

The center Or of the roller 134 may be eccentric with respect to a center Oc of the cylinder 133, that is, the center Oc of the internal space of the cylinder 133. One or a first side of the outer circumferential surface 134*c* of the roller 134 may be in close contact with the inner circumferential surface 133*a* of the cylinder 133. The outer circumferential surface 134*c* of the roller 134 may not actually be in contact with the inner circumferential surface 133*a* of the cylinder 133, but the outer circumferential surface 134*c* of the roller 134 and the inner circumferential surface 133*a* of the cylinder 133 may be spaced apart from each other. Accordingly, without causing frictional damage, it is necessary to limit leakage of a high-pressure refrigerant of a discharge pressure zone into a suction pressure zone through the outer circumferential surface 134*c* of the roller 134 and the inner circumferential surface 133*a* of the cylinder 133. A point of the cylinder 133 with which one side of the roller 134 is nearly in contact may be regarded as contact point P.

The roller 134 may include at least one vane slot 1341*a*, 1341*b*, and 1341*c* formed at a suitable location along the circumferential direction of the outer circumferential surface 134*c*. The vane slot 1341*a*, 1341*b*, and 1341*c* may include first vane slot 1341*a*, second vane slot 1341*b*, and third vane slot 1341*c*. According to one embodiment, an example with three vane slots 1341*a*, 1341*b*, and 1341*c* is described; however, embodiments are not limited thereto. The number of vane slots may be variously changed according to the number of vanes 1351, 1352, and 1353.

Each of the first, second, and third vane slots 1341*a*, 1341*b*, and 1341*c* may be slidably coupled to each of the first, second, and third vanes 1351, 1352, and 1353. Each of the first, second, and third vane slots 1341*a*, 1341*b*, and 1341*c* may be formed in the radial direction with respect to the center Or of the roller 134. That is, a straight line extending from each of the first, second, and third vane slots 1341*a*, 1341*b*, and 1341*c* may pass through the center Or of the roller 134.

First, second, and third back pressure chambers 1342*a*, 1342*b*, and 1342*c* may be respectively formed at respective inner ends of the first, second, and third vane slots 1341*a*, 1341*b*, and 1341*c* capable of allowing each of the first, second, and third vanes 1351, 1352, and 1353 to introduce oil or refrigerant rearward, thereby pressing each of the first, second, and third vanes 1351, 1352, and 1353 toward the inner circumferential surface of the cylinder 133. The first, second, and third back pressure chambers 1342*a*, 1342*b*, and 1342*c* may be sealed by the main bearing 131 and the sub bearing 132. The first, second, and third back pressure chambers 1342*a*, 1342*b*, and 1342*c* may communicate with back pressure pockets 1313 and 1323, respectively. Alternatively, the first, second, and third back pressure chambers 1342*a*, 1342*b*, and 1342*c* may communicate with each other by the back pressure pockets 1313 and 1323.

The back pressure pockets 1313 and 1323 may be formed in the main bearing 131 and the sub bearing 132, respectively, as shown in FIG. 1. Alternatively, the back pressure pockets 1313 and 1323 may be formed in only one of the main bearing 131 and the sub bearing 132. According to one embodiment, an example where the back pressure pockets 1313 and 1323 are formed both in the main bearing 131 and in the sub bearing 132 is provided. The back pressure pockets 1313 and 1323 may include the main-side back pressure pocket 1313 formed in the main bearing 131, and the sub-side back pressure pocket 1323 formed in the sub bearing 132.

The main-side back pressure pocket 1313 may include the first main-side pocket 1313*a* and the second main-side pocket 1313*b*. The second main-side pocket 1313*b* may form a high pressure, compared to the first main-side pocket 1313*a*. The sub-side back pressure pocket 1323 may include the first sub-side pocket 1323*a* and the second sub-side pocket 1323*b*. The second sub-side pocket 1323*b* may form a high pressure, compared to the first sub-side pocket 1323*a*. The first main-side pocket 1313*a* and the first sub-side pocket 1323*a* may communicate with a vane chamber to which a vane located at a relatively upstream side (after the suction stroke and before the discharge stroke) among the vanes 1351, 1352, and 1353 belongs, and the second main-side pocket 1313*b* and the second sub-side pocket 1323*b* may communicate with a vane chamber to which a vane located at a relatively downstream side (after the discharge stroke and before the suction stroke) among the vanes 1351, 1352, and 1352 belongs.

Among the first, second, and third vanes 1351, 1352, and 1353, a vane closest to the contact point P in a compression progression direction may be first vane 1351, the second closest vane may be second vane 1352, and the third closest vane may be third vane 1353. In this case, the first vane 1351 and the second vane 1352, the second vane 1352 and the third vane 1351, and the third vane 1351 and the first vane 1351 may be spaced apart by a same circumferential angle.

A compression chamber formed by the first vane 1351 and the second vane 1352 may be referred to as "first compression chamber V1", a compression chamber formed by the second vane 1352 and the third vane 1351 may be referred to as "second compression chamber V2", and a compression chamber formed by the third vane 1351 and the first vane 1351 may be referred to as "third compression chamber V3." In this case, all the compression chambers V1, V2, and V3 may have a same volume at a same crank angle. Further, the first compression chamber V1 may be referred to as a "suction chamber", and the third compression chamber V3 may be referred to as a "discharge chamber".

Each of the first, second, and third vanes 1351, 1352, and 1353 may be formed in a substantially rectangular parallelepiped shape. Regarding both ends of each of the first, second, and third vanes 1351, 1352, and 1353, a surface adjacent to the inner circumferential surface 133*a* of the cylinder 133 may be referred to as a "front end surface", and a surface opposed to each of the first, second, and third back pressure chambers 1342*a*, 1342*b*, and 1342*c* may be referred to as a "rear end surface".

The front end surface of each of the first, second, and third vanes 1351, 1352, and 1353 may be formed in a curved shape so as to make a line contact with the inner circumferential surface 133*a* of the cylinder 133. The rear end surfaces of the first, second, and third vanes 1351, 1352, and 1353 may be respectively inserted into the first, second, and third back pressure chambers 1342*a*, 1342*b*, and 1342*c* and formed flat to receive a uniform back pressure.

In the rotary compressor 100, when power is applied to the drive motor 120 and the rotor 122 and the rotational shaft 123 are rotated, the roller 134 may be rotated with the rotational shaft 123. In this case, the first, second, and third vanes 1351, 1352, and 1353 may be respectively withdrawn from the first, second, and third vane slots 1341*a*, 1341*b*, and 1341*c* by centrifugal force generated by rotation of the roller 134 and a back pressure generated by each of the first, second, and third back pressure chambers 1342*a*, 1342*b*, and 1342*c*, respectively, disposed at rear sides of the first, second, and third back pressure chamber 1342*a*, 1342*b*, and 1342*c*. The front end surface of each of the first, second, and third vanes 1351, 1352, and 1353 may contact the inner circumferential surface 133*a* of the cylinder 133.

According to one embodiment, if the front end surface of each of the first, second, and third vanes 1351, 1352, and 1353 contacts the inner circumferential surface 133*a* of the cylinder 133, it may mean that the front end surface of each of the first, second, and third vanes 1351, 1352, and 1353 is directly in contact with the inner circumferential surface 133*a* of the cylinder 133 or that the front end surface of each of the first, second, and third vanes 1351, 1352, and 1353 is adjacent enough to directly contact the inner circumferential surface 133*a* of the cylinder 133. The compression space 410 of the cylinder 133 forms compression chambers (including a suction chamber or a discharge chamber) V1, V2, and V3 by the first, second, and third vanes 1351, 1352, and 1353. While moving according to the rotation of the roller 134, the respective compression chambers V1, V2, and V3 of the roller 134 may be varied in volume by eccentricity of the roller 134. The refrigerant filled in each of the compression chambers V1, V2, and V3 may be suctioned and compressed while moving along the roller 134 and the vanes 1351, 1352, and 1353 and discharged.

Each of the first, second, and third vanes 1351, 1352, and 1253 may include upper pins 1351*a*, 1352*a*, and 1353*a* and lower pins 1351*b*, 1352*b*, and 1353*b*. The upper pins 1351*a*, 1352*a*, and 1353*a* may include first upper pin 1351*a* formed in an upper surface of the first vane 1351, second upper pin 1352*a* formed in an upper surface of the second vane 1352, and third upper pin 1351*a* formed in the upper surface of the third vane 1351. The lower pins 1351*b*, 1352*b*, and 1353*b* may include first lower pin 1351*b* formed in a lower surface of the first vane 1351, second lower pin 1352*b* formed in a lower surface of the second vane 1352, and third lower pin 1353*b* formed in a lower surface of the third vane 1353.

The lower surface of the main bearing 131 may include a first rail groove 1317 into which upper pins 1351*a*, 1352*a*, and 1353*a* may be inserted. The first rail groove 1317 may be formed in a circular band shape. The first rail groove 1317 may be disposed adjacent to the rotational shaft 123. The first, second, and third upper pins 1351*a*, 1352*a*, and 1353*a* of the first, second, and third vanes 1351, 1352, and 1353 may be inserted into the first rail groove 1317 so that positions of the first, second, and third vanes 1351 may be guided. Thus, it is possible to prevent direct contact between the vanes 1351, 1352 and 1353 and the cylinder 133, thereby improving compression efficiency and preventing deterioration of reliability due to wear of parts or components.

A lower surface of the main bearing 131 may include a first stepped portion 1318 disposed adjacent to the first rail groove 1317. The first stepped portion 1318 may be disposed between the lower surface of the main bearing 131 and the first rail groove 1317. An outermost side of the first stepped portion 1318 may be disposed inward compared to an outer surface of the roller 134. An innermost side of the first stepped portion 1318 may be disposed outward compared to the rotational shaft 123. The first stepped portion 1318 may increases an area of the compression space 410 to lower the pressure of the compression space 410. As a result, the load applied to the first, second, and third upper pins 1351*a*, 1352*a*, and 1353*a* may be reduced, thereby preventing component damage.

Also, the first stepped portion 1318 may be disposed adjacent to the suction port 1331. The first stepped portion 1318 may increase in width as the first stepped portion 1318 is adjacent to the suction port 1331. More specifically, referring to FIGS. 3, 4, 6, and 7, a cross section of the first stepped portion 1318 may be formed in a half moon shape, the first stepped portion 1318 may be disposed more adjacent to the suction port 1331 than the discharge port 1332, and the first stepped portion 1318 may increase in width as the first stepped portion 1318 is adjacent to the suction port 1331. With such structure, it is possible to improve efficiency by reducing the load applied to the first, second, and third upper pins 1351*a*, 1352*a*, and 1353*a*.

An upper surface of the sub bearing 132 may include a second rail groove 1327 into which the lower pins 1351*b*, 1352*b*, and 1353*b* may be inserted. The second rail groove 1327 may be formed in a circular band shape. The second rail groove 1327 may be disposed adjacent to the rotational shaft 123. The first, second, and third lower pins 1351*b*, 1352*b*, and 1353*b* of the first, second, and third vanes 1351, 1352, and 1353 may be inserted into the second rail groove 1327, so that positions of the first, second, and third vanes 1351 may be guided. Thus, it is possible to prevent direct contact between the vanes 1351, 1352 and 1353 and the cylinder 133, thereby improving compression efficiency and preventing deterioration of reliability due to wear of parts or components.

The first rail groove 1317 and the second rail groove 1327 may be formed in shapes corresponding to each other. The first rail groove 1317 and the second rail groove 1327 may overlap each other in the axial direction. With such structure, it is possible to improve efficiency of guiding positions of the first, second, and third vanes 1351, 1352, and 1353.

The sub bearing 132 may include a second stepped portion 1328 disposed adjacent to the second rail groove 1327. The second stepped portion 1328 may be disposed between an upper surface of the sub bearing 132 and the second rail groove 1327. An outermost side of the second stepped portion 1328 may be disposed inward compared to an outer surface of the roller 134. An innermost side of the second stepped portion 1328 may be disposed outward compared to the rotational shaft 123. With such structure, the second stepped portion 1328 may increases the area of the compression space 410 to lower the pressure of the compression space 410. As a result, a load applied to the first, second, and third lower pins 1351*b*, 1352*b*, and 1353*b* may be reduced, thereby preventing component damage.

Also, the second stepped portion 1328 may be disposed adjacent to the suction port 1331. The second stepped portion 1328 may increase in width as the second stepped portion 1328 is adjacent to the suction port 1331. More specifically, referring to FIGS. 3, 4, 6, and 7, a cross section of the second stepped portion 1328 may be formed in a half moon shape, the second stepped portion 1328 may be disposed more adjacent to the suction port 1331 than the discharge port 1332, and the second stepped portion 1328 may increase in width as the second stepped portion 1328 is adjacent to the suction port 1331. With such structure, it is possible to improve efficiency by reducing the load applied to the first, second, and third lower pins 1351*b*, 1352*b*, and 1353*b*.

The first stepped portion 1318 and the second stepped portion 1328 may be formed in shapes corresponding to each other. The first stepped portion 1318 and the second stepped portion 1328 may overlap each other in the axial direction. With such structure, it is possible to improve efficiency by reducing the load applied to the first, second, and third lower pins 1351*b*, 1352*b*, and 1353*b*.

According to one embodiment, three vanes 1351, 1352, and 1353, three vane slots 1341*a*, 1341*b*, and 1341*c*, and three back pressure chambers 1342*a*, 1342*b*, and 1342*c* have been described. However, the number of the vanes 1351, 1352, and 1353, the number of vane slots 1341*a*, 1341*b*, and 1341*c*, and the number of back pressure chambers 1342*a*, 1342*b*, and 1342*c* may be variously changed.

In addition, according to one embodiment, it has been described that upper pins 1351*a*, 1352*a*, and 1353*a* and lower pins 1351*b*, 1352*b*, and 1353 are all formed in the vanes 1351, 1352, and 1353. However, only the upper pins 1351*a*, 1352*a*, and 1353*a* or only the lower pins 1351*b*, 1352*b*, and 1353 may be formed.

A process in which refrigerant is suctioned and compressed in the cylinder 133 according to an embodiment will be described with reference to FIGS. 8 to 10. Referring to FIG. 8, a volume of the first compression chamber V1 may constantly increase until the first vane 1351 passes through the suction port 1331 and the second vane 1352 reaches a suctioning completing time. In this case, refrigerant may be constantly introduced from the suction port 1331 to the first compression chamber V1.

The first back pressure chamber 1342*a* disposed at a rear side of the first vane 1351 may be exposed to the first main-side pocket 1313*a* of the main-side back pressure pocket 1313, and the second back pressure chamber 1342*b* disposed at a rear side of the second vane 1352 may be exposed to the second main-side pockets 1313*b* of the main back pressure pocket 1313. Accordingly, an intermediate pressure may be formed in the first back pressure chamber 1342*a*, thereby pressurizing the first vane 1351 with the intermediate pressure so that the first vane 1351 is brought into close contact with the inner circumferential surface 133*a* of the cylinder 133. In addition, a discharge pressure or a pressure close to the discharge pressure may be formed in the second back pressure chamber 1342*b*, thereby pressurizing the second vane 1352 with the discharge pressure so that the second vane 1352 is brought into close contact with the inner circumferential surface 133*a* of the cylinder 133.

Referring to FIG. 9, when the second vane 1352 proceeds with a compression stroke past the suction completing time (or a compression starting time), the first compression chamber V1 may become sealed and be moved with the roller 134 in a direction toward the discharge port. In this process, the volume of the first compression chamber (V1) may be constantly reduced, and the refrigerant in the first compression chamber V1 may be gradually compressed.

Referring to FIG. 10, when the first vane 1351 has passed by the discharge port 1332 and the second vane 1352 has not yet reached the discharge port 1332, the first compression chamber V1 may communicate with the discharge port 1332, thereby causing the discharge valve 1335 to be opened by the pressure of the first compression chamber V1. In this case, the refrigerant in the first compression chamber V1 may be discharged through the discharge port 1332 into the internal space of the casing 110.

At this time, the first back pressure chamber 1342*a* of the first vane 1351 may be located just before entering the first main-side pocket 1313*a*, which is an intermediate pressure zone, after passing through the second side pocket 1313*b*, which is a discharge pressure zone. Therefore, the back pressure formed in the first back pressure chamber 1342*a* of the first vane 1351 may be lowered from the discharge pressure to the intermediate pressure. On the other hand, the second back pressure chamber 1342*b* of the second vane 1352 may be located in the second main-side pocket 1313*b*, which is the discharge pressure zone, and a back pressure corresponding to the discharge pressure may be formed in the second back pressure chamber 1342*b*.

As a result, an intermediate pressure between the suction pressure and the discharge pressure may be formed at the rear end of the first vane 1351 located in the first main-side pocket 1313*a*, and a discharge pressure (which is actually a pressure slightly lower than the discharge pressure) may be formed at the rear end of the second vane 1352 located in the second main-side pocket 1313*b*. In particular, as the second main-side pocket 1313*b* directly communicates with the oil flow path 125 through the first oil flow path 126*a* and the first communication flow path 1315, it is possible to prevent the pressure of the second back pressure chamber 1342*b* communicating with the second main-side pocket 1313*b* from rising above the discharge pressure. Accordingly, an intermediate pressure lower than the discharge pressure may be formed in the first side first pocket 1313*a*, thereby increasing mechanical efficiency between the cylinder 133 and the vanes 1351, 1352, and 1353. In addition, the discharge pressure or a pressure slightly lower than the discharge pressure may be formed in the second main-side pocket 1313*b* and the vanes 1351, 1352, and 1353 are disposed adjacent to the cylinder 133, thereby increasing mechanical efficiency while preventing leakage between compression chambers.

Referring to FIG. 11, in the rotary compressor 100 according to an embodiment, pressure applied to the upper pins 1351*a*, 1352*a*, and 1353*a* and/or the lower pins 1351*b*, 1352*b*, and 1353*b* of the vanes 1351, 1352, and 1353 may be lowered. An upper line in a graph in FIG. 11 may refer to pressure applied to the upper pins 1351*a*, 1352*a*, and 1353*a* and/or the lower pins 1351*b*, 1352*b*, and 1353*b* of the vanes 1351, 1352, and 1353 in a conventional rotary compressor 100. A lower line in the graph in FIG. 11 may refer to pressure applied to the upper pins 1351*a*, 1352*a*, and 1353*a* and/or the lower pins 1351*b*, 1352*b*, and 1353*b* of the vanes 1351, 1352, and 1353 in the rotary compressor 100 according to an embodiment. That is, by reducing the load applied to the upper pins 1351*a*, 1352*a*, and 1353*a* and/or the lower pins 1351*b*, 1352*b*, and 1353*b*, it is possible to prevent damage to components.

Figure 12:
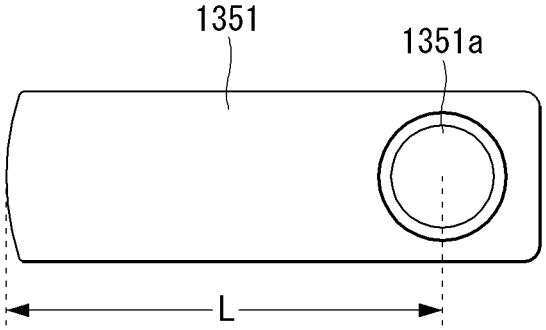
FIG. 12 is a plan view of a vane of a rotary compressor according to an embodiment.
Figure 13:
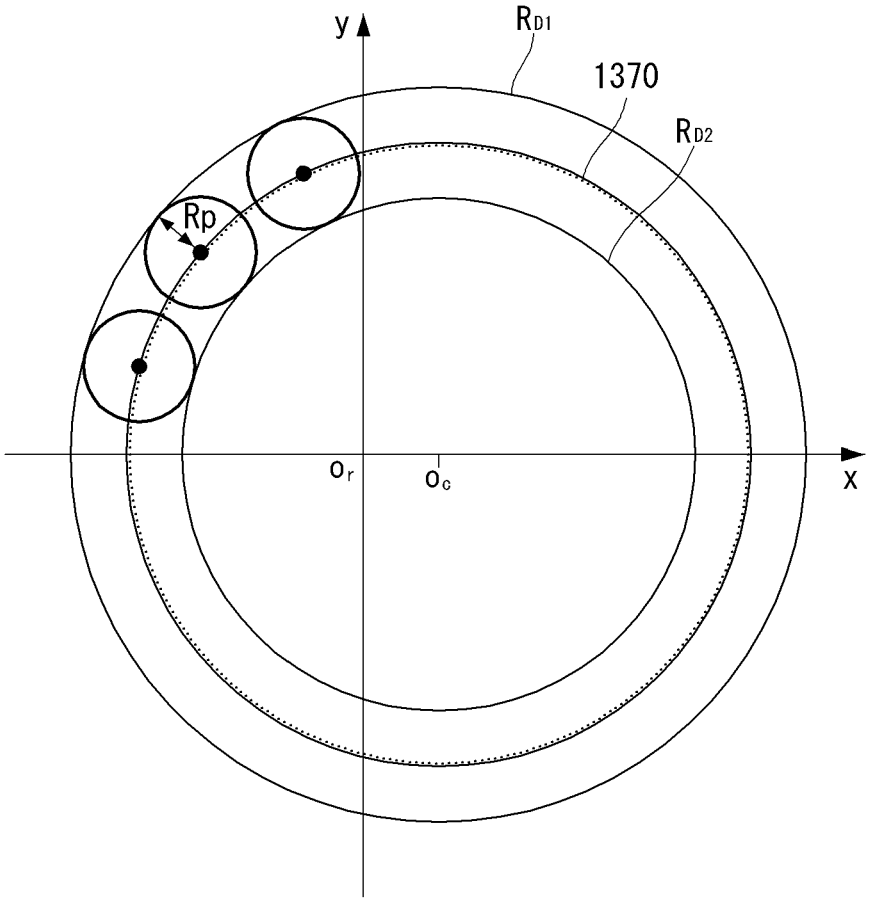
FIG. 13 is a coordinate diagram of a rail groove of a rotary compressor according to an embodiment.

FIG. 12 is a plan view of a vane of a rotary compressor according to an embodiment. FIG. 13 is a coordinate diagram of a rail groove of a rotary compressor according to an embodiment.

Referring to FIGS. 12 and 13, the pins 1351*a*, 1352*a*, 1353*a*, 1351*b*, 1352*b*, and 1353*b* of the vanes 1351, 1352, and 1353 may be inserted into rail grooves 1317 and 1327. In this case, the rail grooves 1317 and 1327 may each be formed in a circular shape, but the shapes of the rail grooves 1317 and 1327 may be variously changed.

Referring to FIG. 13, the center of each of the rail grooves 1317 and 1327 may be concentric with the center Oc of the inner circumferential surface 133*a* of the cylinder 133. In this case, the center of each of the rail grooves 1317 and 1327 may be eccentric with respect to the center Or of the outer circumferential surface 134*c* of the roller 134, and may have an eccentricity e.

Each of the rail grooves 1317 and 1327 may have an inner diameter $R_{D2}$ and an outer diameter $R_{D1}$. A line passing through centers of the inner diameter $R_{D2}$ and the outer diameter $R_{D1}$ of each of the rail grooves 1317 and 1327 may be defined as a base circle 1370 of each of the rail grooves 1317 and 1327.

In this case, a difference between the inner diameter $R_{D2}$ and the outer diameter $R_{D1}$ of each of the rail grooves 1317 and 1327 may correspond to a width of each of the pins 1351*a*, 1352*a*, 1353*a*, 1351*b*, 1352*b*, and 1353*b* of the vanes 1351, 1352, and 1353. The difference between the inner diameter $R_{D2}$ and the outer diameter $R_{D1}$ of each of the rail grooves 1317 and 1327 may be twice a radius Rp of each of the pins 1351*a*, 1352*a*, 1353*a*, 1351*b*, 1352*b*, and 1353*b*.

Figure 14:
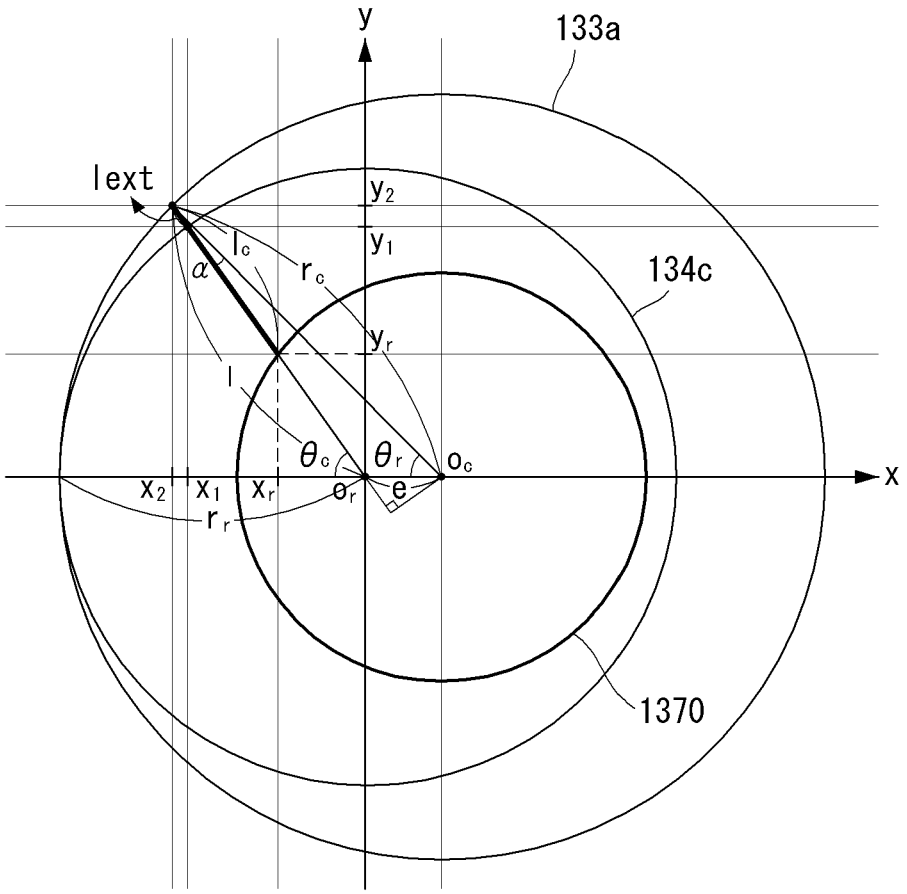
FIG. 14 is a coordinate diagram of a compression unit of a rotary compressor according to an embodiment.

FIG. 14 is a coordinate diagram of a compression unit of a rotary compressor according to an embodiment. Referring to FIG. 14, a center of the coordinate system may be defined as the center Or of the outer circumferential surface 134*c* of the roller 134. In this case, a center of the base circle 1370 of each of the rail grooves 1317 and 1327 and the center Oc of the inner circumferential surface 133*a* of the cylinder 133 may have an eccentricity e with respect to the center Or of the outer circumferential surface 134*c* of the roller 134. In the rotary compressor 100 according to an embodiment, as the roller 134 is capable of being rotated, the center Or of the outer circumferential surface 134*c* of the roller 134, which is the center of rotation, may be set as the origin of the coordinate system.

The inner circumferential surface 133*a* of the cylinder 133 may be formed in a circular shape, and the outer circumferential surface 134*c* of the roller 134 may be formed in a circular shape. The base circle 1370 of each of the rail grooves 1317 and 1327 and the inner circumferential surface 133*a* of the cylinder 133 may be concentric. The center of the base circle 1370 of each of the rail grooves 1317 and 1327 may be eccentric with respect to the center of the outer circumferential surface 134*c* of the roller 134. A straight line passing through the vanes 1351, 1352, and 1353 in a direction vertical to the rotational shaft 123 may pass through the center Or of the outer circumferential surface 134*c* of the roller 134.

The coordinates of the base circle 1370 of each of the rail grooves 1317 and 1327 may satisfy Equations 1 and 2 below.

$$x_r = x_2 + l_c \cos\theta_c \quad \text{[Equation 1]}$$

Where $x_r$ denotes the x-coordinate of the base circle 1370 of each of the rail grooves 1317 and 1327, $x_2$ denotes the x-coordinate of the inner circumferential surface 133*a* of the cylinder 133, $l_c$ denotes a distance between the base circle 1370 of each of the rail grooves 1317 and 1327 and the inner circumferential surface 133*a* of the cylinder 133, and $\theta_c$ denotes the rotational angle of the roller 134.

$$y_r = y_2 - l_c \sin\theta_c \quad \text{[Equation 2]}$$

Where $y_r$ denotes the y-coordinate of the base circle 1370 of each of the rail grooves 1317 and 1327, $y_2$ denotes the y-coordinate of the inner circumferential surface 133*a* of the cylinder 133, $l_c$ denotes a distance between the base circle 1370 of each of the rail grooves 1317 and 1327 and the inner circumferential surface 133*a* of the cylinder 133, and $\theta_c$ denotes the rotational angle of the roller 134. $l_c$, which is the distance between the inner circumferential surface 133*a* of the cylinder 133 and the base circle 1370 of each of the rail grooves 1317 and 1327, may indicate a distance on a straight line passage from the inner circumferential surface 133*a* of the cylinder 133 to the center Or of the outer circumferential surface 134*c* of the roller 134.

Through the rail grooves 1317 and 1327 and the pins 1351*a*, 1352*a*, 1353*a*, 1351*b*, 1352*b*, and 1353*b*, the front end surfaces of the vanes 1351, 1352, and 1353 may be spaced at a predetermined distance from the inner circumferential surface 133*a* of the cylinder 133. In this case, the predetermined distance between each of the front end surfaces of the vanes 1351, 1352, and 1353 and the inner circumferential surface 133*a* of the cylinder 133 may be 10 μm to 20 μm. Therefore, it is possible to improve compression efficiency by preventing a refrigerant from leaking into the space between the front end surfaces of the vanes and the inner circumferential surface of the cylinder.

Coordinates of the outer circumferential surface 134*c* of the roller 134 may satisfy Equations 3 and 4 below.

$$x_1 = -r_r \cos\theta_c \quad \text{[Equation 3]}$$

Where $x_1$ denotes the x-coordinate of the outer circumferential surface 134*c* of the roller 134, $r_r$ denotes a radius of the outer circumferential surface 134*c* of the roller 134, and $\theta_c$ denotes the rotational angle of the roller 134.

$$y_1 = r_r \sin\theta_c \quad \text{[Equation 4]}$$

Where $y_1$ denotes the y-coordinate of the outer circumferential surface 134*c* of the roller 134, $r_r$ denotes the radius of the outer circumferential surface 134*c* of the roller 134, and $\theta_c$ (denotes the rotational angle of the roller 134.

In addition, the coordinates of the inner circumferential surface 133*a* of the cylinder 133 may satisfy Equations 5 and 6 below.

$$x_2 = -r_c \cos\theta_r + e \quad \text{[Equation 5]}$$

Where $x_2$ denotes the x-coordinate of the inner circumferential surface 133*a* of the cylinder 133, $r_c$ denotes the radius of the inner circumferential surface 133*a* of the cylinder 133, and $\theta_r$ denotes the rotational angle of each of the pins 1351*a*, 1352*a*, 1353*a*, 1351*b*, 1352*b*, and 1353*b* relative to each of the rail grooves 1317 and 1318, and e denotes an amount of eccentricity.

$$y_2 = r_c \sin\theta_r \quad \text{[Equation 6]}$$

Where $y_2$ denotes the y-coordinate of the inner circumferential surface 133*a* of the cylinder 133, $r_c$ denotes the radius of the inner circumferential surface 133*a* of the cylinder 133, and $\theta_r$ denotes the rotational angle of each of the pins 1351*a*, 1352*a*, 1353*a*, 1351*b*, 1352*b*, and 1353*b* relative to each of the rail grooves 1317 and 1318.

In addition, an amount of protrusion $l_{ext}$ of the vanes 1351, 1352 and 1353 with respect to the outer circumferential surface 134*c* of the roller 134 may satisfy Equation 7 below.

$$l_{ext}=\sqrt{(x_2-x_1)^2+(y_2-y_1)^2} \quad \text{[Equation 7]}$$

Where text denotes the amount of protrusion of each of the vanes 1351, 1352, and 1353, $x_2$ denotes the x-coordinate of the inner circumferential surface 133*a* of the cylinder 133, $x_1$ denotes the x-coordinate of the outer circumferential surface 134*c* of the roller 134, $y_2$ denotes the y-coordinate of the inner circumferential surface 133*a* of the cylinder 133, and $y_1$ denotes the y-coordinate of the outer circumferential surface 134*c* of the roller 134.

Figure 15:
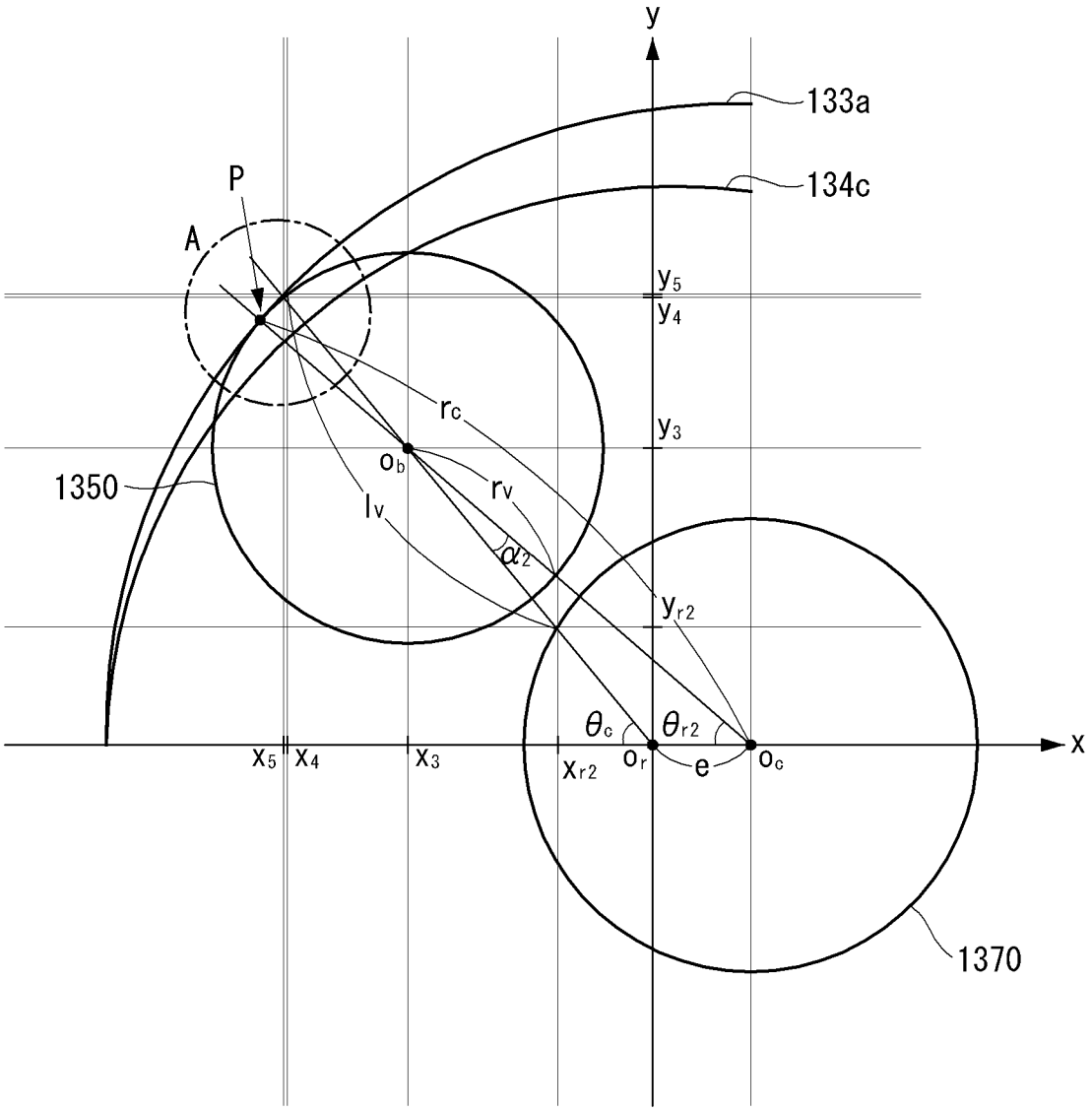
FIG. 15 is a coordinate diagram of a compression unit of a rotary compressor according to an embodiment.
Figure 16:
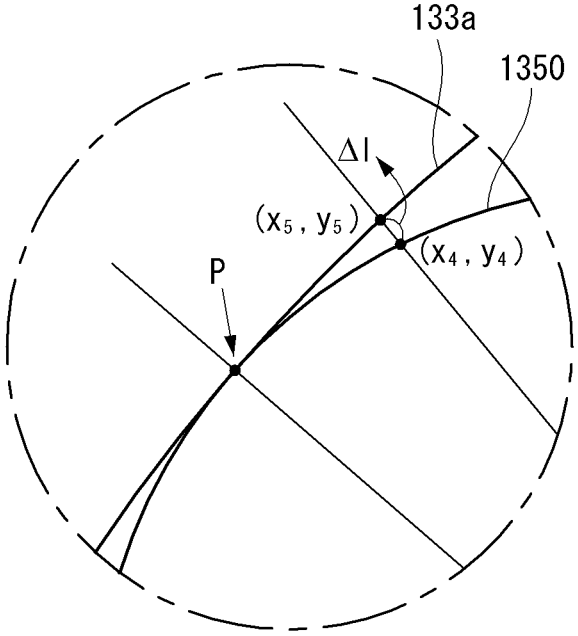
FIG. 16 is an enlarged view of portion A of FIG. 15.

FIG. 15 is a coordinate diagram of a compression unit of a rotary compressor according to an embodiment. FIG. 16 is an enlarged view of portion A of FIG. 15.

Referring to FIG. 12, a front end surface 1350 of each of the vanes 1351, 1352 and 1353 adjacent to the inner circumferential surface 133*a* of the cylinder 133 may have a curved shape. In this case, as shown in FIG. 16, an error may occur due to a distance between a contact point P, at which the inner circumferential surface 133*a* of the cylinder 133 is closest to the front end surface 1350 of the vanes 1351, 1352, and 1353, and a center of the front end surface 1350 of each of the vanes 1351, 1352, and 1353. More specifically, as the front end surface 1350 of each of the vanes 1351, 1352, and 1353 has a curved shape, coordinates of the front end surface of each of the vanes 1351, 1352, and 1353 may be changed from (x5, y5) to (x4, y4), and thus, an error may occur. The coordinates (x5, y5) of FIG. 16 may be understood as the same coordinates as the coordinates (x2, y2) of FIG. 14.

Considering the above, the coordinates of the basic circle 1370 of each of the rail grooves 1317 and 1327 may satisfy Equations 8 and 9 below.

$$x_{r2}=x_2+(l_v+\Delta l)\cos\theta_c \quad \text{[Equation 8]}$$

Where $x_{r2}$ denotes the x-coordinate of the base circle 1370 of each of the rail grooves 1317 and 1327, $x_2$ denotes the x-coordinate of the inner circumferential surface 133*a* of the cylinder 133, $l_v$ denotes the distance between the inner circumferential surface 133*a* of the cylinder 133 and the base circle 1370 of each of the rail grooves 1317 and 1327, Δl denotes the distance between the inner circumferential surface 133*a* of the cylinder 133 and each of the vanes 1351, 1352, and 1353, and $\theta_c$ denotes the rotational angle of the roller 134.

$$x_{r2}=x_2+(l_v+\Delta l)\cos\theta_c \quad \text{[Equation 9]}$$

Where $y_{r2}$ denotes the y-coordinate of the base circle 1370 of each of the rail grooves 1317 and 1327, $y_2$ denotes the y-coordinate of the inner circumferential surface 133*a* of the cylinder 133, and $l_v$ denotes the distance between the inner circumferential surface 133*a* of the cylinder 133 and the base circle 1370 of each of the rail grooves 1317 and 1327, Δl denotes the distance between the inner circumferential surface 133*a* of the cylinder 133 and each of the vanes 1351, 1352, and 1353, and $\theta_c$ denotes the rotational angle of the roller 134. lv, which is the distance between the inner circumferential surface 133*a* of the cylinder 133 and the base circle 1370 of each of the rail grooves 1317 and 1327, may indicate a distance on a straight line passing from the inner circumferential surface 133*a* of the cylinder 133 to the center Or of the outer circumferential surface 134*c* of the roller 134. In addition, the distance between the inner circumferential surface 133*a* of the cylinder 133 and each of the vanes 1351, 1352, and 1353 may be a distance on a straight line passing from the inner circumferential surface 133*a* of the cylinder 133 to the center Or of the outer circumferential surface 134*c* of the roller 134.

Through the rail grooves 1317 and 1327 and the pins 1351*a*, 1352*a*, 1353*a*, 1351*b*, 1352*b*, and 1353*b*, the front end surfaces of the vanes 1351, 1352, and 1353 may be spaced at a predetermined distance from the inner circumferential surface 133*a* of the cylinder 133. In this case, the predetermined distance between each of the front end surfaces of the vanes 1351, 1352, and 1353 and the inner circumferential surface 133*a* of the cylinder 133 may be 10 μm to 20 μm. Therefore, it is possible to improve compression efficiency by preventing refrigerant from leaking into the space between the front end surfaces of the vanes and the inner circumferential surface of the cylinder.

Further, as the radius of the front end surface 1350 of each of the vanes 1351, 1352, and 1353 designed by the shape coordinates of the base circle 1370 of each of the rail grooves 1317 and 1327 is smaller than the radius of the inner circumferential surface 133*a* of the cylinder 133, it is possible to reduce noise generated by reducing the line speed.

Certain embodiments described herein or other embodiments are not mutually exclusive or distinct from each other. Any or all of the embodiments described may be combined or combined with each other.

For example, this means that configuration A described in a specific embodiment and/or drawings and configuration B described in other embodiments and/or drawings may be combined. That is, even if the combination between configurations is not described directly, the combination is possible except for a case in which the combination is impossible.

According to embodiments disclosed herein, a rotary compressor is provided capable of improving a compression efficiency by preventing contact between the vane and the cylinder. In addition, according to embodiments disclosed herein, a rotary compressor is provided capable of preventing contact between the vane and the cylinder, thereby preventing reliability from being reduced due to wear.

In addition, according to embodiments disclosed herein, a rotary compressor is provided capable of improving the compression efficiency by preventing leakage of a refrigerant into a space between a front end surface of the vane and an inner circumferential surface of the cylinder. In addition, according to embodiments disclosed herein, a rotary compressor is provided capable of preventing damage to a product by reducing a load applied to the pin of the vane. By reducing a radius of the front end surface of the vane, designed by shape coordinates of the base circle of the rail groove, than the radius of the inner circumferential surface of the cylinder, according to embodiments disclosed herein, a rotary compressor is provided capable of reducing noise generated by reducing a line speed.

Embodiments disclosed herein provide a rotary compressor that may include a rotational shaft, a first bearing and a second bearing each supporting the rotational shaft in a radial direction, a cylinder disposed between the first bearing and the second bearing and forming a compression space, a roller disposed in the compression space to form a contact point spaced at a predetermined interval from the cylinder and coupled to the rotational shaft to compress a refrigerant in response to rotation of the roller, and at least one vane slidably inserted into the roller and in contact with an inner circumferential surface of the cylinder, dividing the compression space into a plurality of compression chambers. Each of the at least one vane may include a pin extending upward or downward, and a lower surface of the first bearing or an upper surface of the second bearing may include a rail groove into which the pin is inserted. With such structure, it is possible to prevent contact between the vane and the cylinder, thereby improving compression efficiency. In addition, it is possible to prevent contact between the vane and the cylinder, thereby preventing reliability from being deteriorated due to wear.

Coordinates of a base circle of the rail groove may satisfy the following equations: $x_r=x_1+l_c \cos \theta_c$, where $x_r$ denotes an x-coordinate of the base circle of the rail groove, $x_2$ denotes an x-coordinate of the inner circumferential surface of the cylinder, $l_c$ denotes a distance between the inner circumferential surface of the cylinder and the base circle of the rail groove, and $\theta_c$ denotes a rotational angle of the roller; and $y_r=y_2-l_c \sin \theta_c$, where $y_r$ denotes an y-coordinate of the base circle of the rail groove, $y_2$ denotes an y-coordinate of the inner circumferential surface of the cylinder, $l_c$ denotes a distance between the inner circumferential surface of the cylinder and the base circle of the rail groove, and $\theta_c$ denotes a rotational angle of the roller. With such structure, it is possible to prevent a refrigerant from leaking into the space between the front end surface of the vane and the inner circumferential surface of the cylinder, thereby improving compression efficiency. It is possible also to prevent damage to a product by reducing a load applied to the pins of the vane.

A distance between the inner circumferential surface of the cylinder and the base circle of the rail groove may be a distance on a straight line that passes from the inner circumferential surface of the cylinder to a center of the base circle of the rail groove. The inner circumferential surface of the cylinder may be formed in a circular shape, and an outer circumferential surface of the roller may be formed in a circular shape.

An amount of protrusion of the at least one vane from an outer circumferential surface of the roller may satisfy the following equation $l_{ext}=\sqrt{(x_2-x_1)^2+(y_2-y_1)^2}$, where $l_{ext}$ denotes the amount of protrusion of the at least one vane, $x_2$ denotes an x-coordinate of the inner circumferential surface of the cylinder, $x_1$ denotes an x-coordinate of the outer circumferential surface of the roller, $y_2$ denotes an y-coordinate of the inner circumferential surface of the cylinder, and $y_1$ denotes an y-coordinate of the outer circumferential surface of the roller. The base circle of the rail groove and the inner circumferential surface of the cylinder may be concentric.

A center of the base circle of the rail groove may be eccentric with respect to a center of an outer circumferential surface of the roller. The base circle of the rail groove may correspond to a center of the inner circumferential surface of the rail groove and a center of an outer circumferential surface of the rail groove.

A straight line passing through the at least one vane in a direction vertical to the rotational shaft may pass through a center of an outer circumferential surface of the roller. A front end surface of the at least one vane facing the inner circumferential surface of the cylinder and the inner circumferential surface may not be in contact with each other. A distance between a front end surface of the at least one vane facing the inner circumferential surface of the cylinder and the inner circumferential surface of the cylinder may be 10 μm to 20 μm.

Embodiments disclosed herein provide a rotary compressor that may include a rotational shaft, a first bearing and a second bearing each supporting the rotational shaft in a radial direction, a cylinder disposed between the first bearing and the second bearing and forming a compression space, a roller disposed in the compression space to form a contact point spaced at a predetermined interval from the cylinder and coupled to the rotational shaft to compress a refrigerant in response to rotation of the roller, and at least one vane slidably inserted into the roller and in contact with an inner circumferential surface of the cylinder, dividing the compression space into a plurality of compression chambers. Each of the at least one vane may include a pin extending upward or downward, and a lower surface of the first bearing or an upper surface of the second bearing may include a rail groove into which the pin is inserted. With such structure, it is possible to prevent contact between the vane and the cylinder, thereby improving compression efficiency. In addition, it is possible to prevent contact between the vane and the cylinder, thereby preventing reliability from being deteriorated due to wear.

Coordinates of a base circle of the rail groove may satisfy the following equations: $x_{r2}=x_2+(l_v+\Delta l) \cos \theta_c$ where $x_{r2}$ denotes an x-coordinate of the base circle of the rail groove, $x_2$ denotes an x-coordinate of the inner circumferential surface of the cylinder, $l_v$ denotes a distance between the inner circumferential surface of the cylinder and the base circle of the rail groove, $\Delta l$ denotes a distance between the inner circumferential surface of the cylinder and the at least one vane, and $\theta_c$ denotes a rotational angle of the roller; and $y_{r2}=y_2-(l_v+\Delta l) \sin \theta_c$ where $y_{r2}$ denotes an y-coordinate of the base circle of the rail groove, $y_2$ denotes an y-coordinate of the inner circumferential surface of the cylinder, denotes a distance between the inner circumferential surface of the cylinder and the base circle of the rail groove, $\Delta l$ denotes a distance between the inner circumferential surface of the cylinder and the at least one vane, and $\theta_c$ denotes a rotational angle of the roller. With such structure, it is possible to prevent a refrigerant from leaking into the space between the front end surface of the vane and the inner circumferential surface of the cylinder, thereby improving compression efficiency. In addition, it is possible to prevent damage to a product by reducing a load applied to the pins of the vane.

As a radius of the front end surface of the vane designed by shape coordinates of the base circle of the rail groove is smaller than a radius of the inner circumferential surface of the cylinder, it is possible to reduce noise generated by reducing line speed. Further, the distance between the inner circumferential surface of the cylinder and the base circle of the rail groove may be a distance on a straight line that passes from the inner circumferential surface of the cylinder to a center of the base circle of the rail groove. Furthermore, the distance between the inner circumferential surface of the cylinder and the at least one vane may be a distance on a straight line passing from the inner circumferential surface of the cylinder to a center of an outer circumferential surface of the roller.

A front end surface of the at least one vane facing the inner circumferential surface of the cylinder may be formed in a curved shape. The inner circumferential surface of the cylinder may be formed in a circular shape, and an outer circumferential surface of the roller may be formed in a circular shape. The base circle of the rail groove and the inner circumferential surface of the cylinder may be concentric.

A center of the base circle of the rail groove may be eccentric with respect to a center of an outer circumferential surface of the roller. A straight line passing through the at least one vane in a direction vertical to the rotational shaft may pass through a center of an outer circumferential surface of the roller.

A front end surface of the at least one vane facing the inner circumferential surface of the cylinder and the inner circumferential surface may not be in contact with each other. A distance between a front end surface of the at least one vane facing the inner circumferential surface of the cylinder and the inner circumferential surface of the cylinder may be 10 μm to 20 μm.

The above detailed description should not be construed in all aspects as limiting and should be considered illustrative. The scope should be determined by rational interpretation of the appended claims, and all changes within the scope of equivalents are included in the scope.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A rotary compressor, comprising:

a rotational shaft;

a first bearing and a second bearing that each supports the rotational shaft in a radial direction; a cylinder disposed between the first bearing and the second bearing and forming a compression space;

a roller disposed in the compression space and coupled to the rotational shaft to compress a refrigerant in response to rotation of the roller; and at least one vane slidably inserted into the roller and in contact with an inner circumferential surface of the cylinder, dividing the compression space into a plurality of compression chambers, wherein each of the at least one vane comprises a pin that extends in an axial direction of the rotational shaft, wherein an inner surface of the first bearing or an inner surface of the second bearing comprises a rail groove into which the pin is inserted, and wherein coordinates of a base circle of the rail groove satisfies the following equations:

$x_{r2}=x_2+(l_v+\Delta l)\cos\theta_c$, where $x_{r2}$ denotes an x-coordinate of the base circle of the rail groove, $x_2$ denotes an x-coordinate of the inner circumferential surface of the cylinder, $l_v$ denotes a distance between the inner circumferential surface of the cylinder and the base circle of the rail groove, $\Delta l$ denotes a distance between the inner circumferential surface of the cylinder and the at least one vane, and $\theta_c$ denotes a rotational angle of the roller; and $y_{r2}=y_2-(l_v+\Delta l)\sin\theta_c$ where $y_{r2}$ denotes an y-coordinate of the base circle of the rail groove, $y_2$ denotes an y-coordinate of the inner circumferential surface of the cylinder, $l_v$ denotes a distance between the inner circumferential surface of the cylinder and the base circle of the rail groove, $\Delta l$ denotes a distance between the inner circumferential surface of the cylinder and the at least one vane, and $\theta_c$ denotes the rotational angle of the roller;

wherein the distance between the inner circumferential surface of the cylinder and the base circle of the rail groove is a distance on a straight line that passes from the inner circumferential surface of the cylinder to a center of an outer circumferential surface of the roller; wherein the distance between the inner circumferential surface of the cylinder and the at least one vane is a distance on a straight line that passes from the inner circumferential surface of the cylinder to the center of the outer circumferential surface of the roller;

wherein a front end surface of the at least one vane facing the inner circumferential surface of the cylinder is formed in a curved shape; wherein the inner circumferential surface of the cylinder is formed in a circular shape and the outer circumferential surface of the roller is formed in a circular shape;

wherein the base circle of the rail groove and the inner circumferential surface of the circular cylinder are concentric; wherein a center of the base circle of the rail groove is eccentric with respect to the center of the outer circumferential surface of the roller; wherein a straight line that passes through the at least one vane in a direction orthogonal to the axial direction of the rotational shaft passes through the center of the outer circumferential surface of the roller; and wherein the front end surface of the at least one vane facing the inner circumferential surface of the circular cylinder and the inner circumferential surface of the circular cylinder are not in contact with each other based on shape coordinates of the base circle of the rail groove for improving leakage prevention efficiency of refrigerant and reducing noise generated by reducing the line speed.

2. The rotary compressor of claim 1, wherein a distance between the front end surface of the at least one vane facing the inner circumferential surface of the cylinder and the inner circumferential surface of the cylinder is 10 μm to 20 μm.

* * * * *